US012459032B2

(12) United States Patent
Priuli

(10) Patent No.: US 12,459,032 B2
(45) Date of Patent: Nov. 4, 2025

(54) METHOD AND APPARATUS FOR BINDING METAL WIRES AND SIMILAR PRODUCTS

(71) Applicant: SCHNELL S.P.A., Colli al Metauro (IT)

(72) Inventor: Elia Priuli, Colli al Metauro (IT)

(73) Assignee: SCHNELL S.P.A., Colli al Metauro (IT)

( * ) Notice: Subject to any disclaimer, the term of this patent is extended or adjusted under 35 U.S.C. 154(b) by 199 days.

(21) Appl. No.: 18/026,755

(22) PCT Filed: Sep. 16, 2021

(86) PCT No.: PCT/IT2021/050284
§ 371 (c)(1),
(2) Date: Mar. 16, 2023

(87) PCT Pub. No.: WO2022/059044
PCT Pub. Date: Mar. 24, 2022

(65) Prior Publication Data

US 2023/0347405 A1 Nov. 2, 2023

(30) Foreign Application Priority Data

Sep. 16, 2020 (IT) ..... 102020000021862

(51) Int. Cl.
*B21F 7/00* (2006.01)
*B21F 15/04* (2006.01)
*E04G 21/12* (2006.01)

(52) U.S. Cl.
CPC ..... *B21F 7/00* (2013.01); *B21F 15/04* (2013.01); *E04G 21/123* (2013.01)

(58) Field of Classification Search
CPC ..... B21F 15/00; B21F 15/02; B21F 15/04; B65B 13/22; B65B 13/28; B65B 13/285;
(Continued)

(56) References Cited

U.S. PATENT DOCUMENTS 4,542,773 A 9/1985 Lafon
5,323,816 A * 6/1994 Hoyaukin ..... E04G 21/122 140/57

(Continued)

FOREIGN PATENT DOCUMENTS

EP 0017674 A1 10/1980
EP 0751270 A1 1/1997

(Continued)

OTHER PUBLICATIONS

Japanese Office Action (with English Translation) issued in corresponding Application No. JP 2023-517289 dated Apr. 22, 2025, pp. 1-3.

(Continued)

*Primary Examiner* — Bobby Yeonjin Kim
(74) *Attorney, Agent, or Firm* — Tutunjian & Bitetto, P.C.

(57) ABSTRACT

The method for binding metal wires and similar products around a first element and a second element, in particular having an elongated shape, for example reinforcing rods, includes the step of preparing the first element and the second element in a crossed superimposed configuration, so as to define four respective quadrants (Q1, Q2, Q3, Q4) at a crossing zone, on a plane containing the longitudinal axis (Y) of one of the first element and the second element, and the projection (P) of the longitudinal axis of the other. The method then provides for inserting a calendering assembly mounted around a binding axis (A, A') in front of a binding apparatus, abutting against at least one of the first element and the second element, at the crossing area, engaging the four quadrants (Q1, Q2, Q3, Q4).

11 Claims, 33 Drawing Sheets

(58) Field of Classification Search
CPC ..... B65B 13/025; B65B 13/04; B65B 13/06; B65B 27/10; B25B 25/00; E04G 21/123
See application file for complete search history.

(56) References Cited

U.S. PATENT DOCUMENTS

| | | | |
|---|---|---|---|
| 5,842,506 | A | 12/1998 | Peters |
| 5,944,064 | A | 8/1999 | Saito et al. |
| 2011/0155277 | A1 | 6/2011 | Coles et al. |

FOREIGN PATENT DOCUMENTS

| | | | | | |
|---|---|---|---|---|---|
| EP | 0757143 | A1 | | 2/1997 | |
| EP | 1440746 | A1 | | 7/2004 | |
| GB | 367254 | A | * | 2/1932 | ..... E04C 5/166 |
| JP | 2003-013548 | A | | 1/2003 | |
| JP | 2020-051205 | A | | 4/2020 | |
| WO | 1995/005313 | A1 | | 2/1995 | |

OTHER PUBLICATIONS

International Search Report for PCT/IT2021/050284 dated Jan. 25, 2022 (2 pages).

* cited by examiner

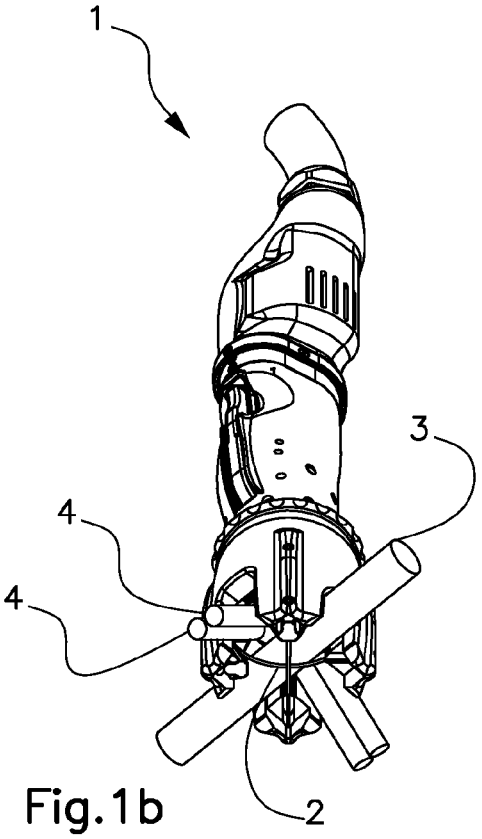
Fig.1b
Fig.1a
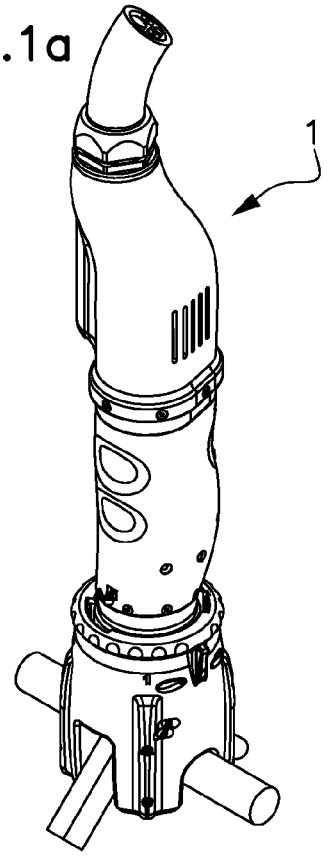
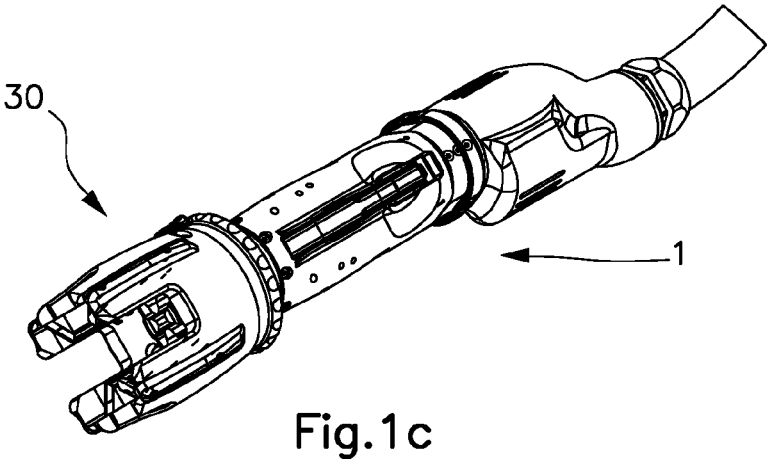
Fig.1c

Fig.9a
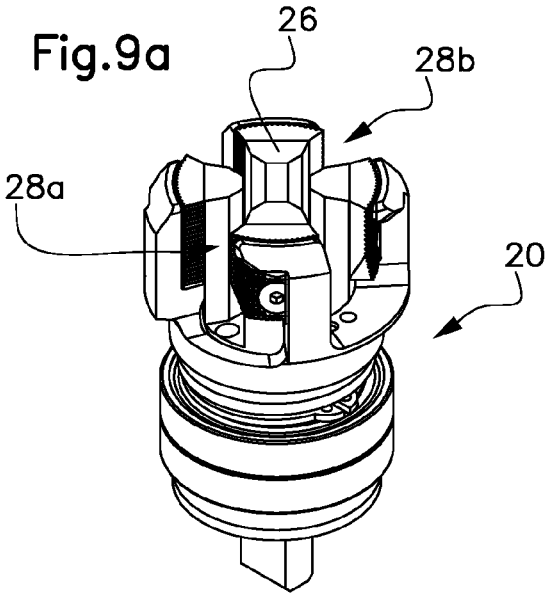
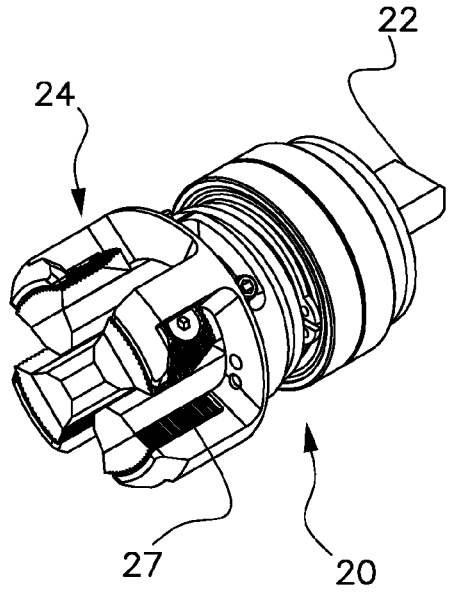
Fig.9b
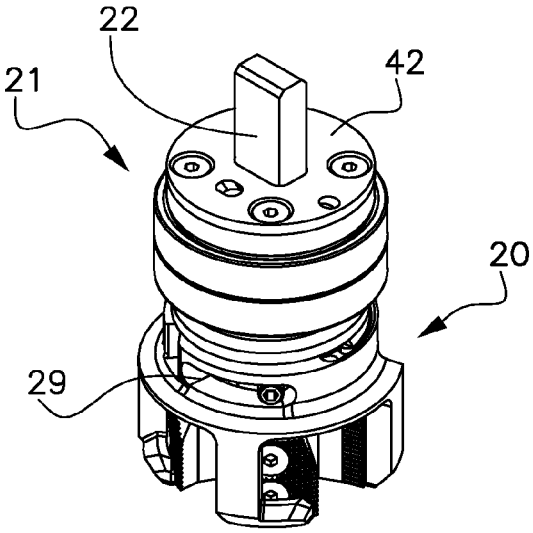
Fig.9c

Fig.11a
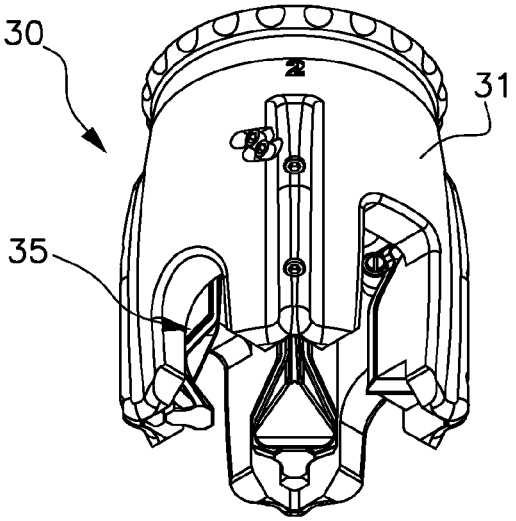
Fig.11b
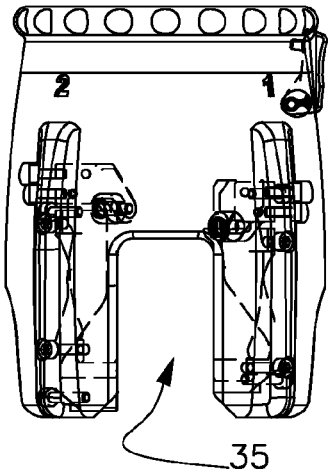
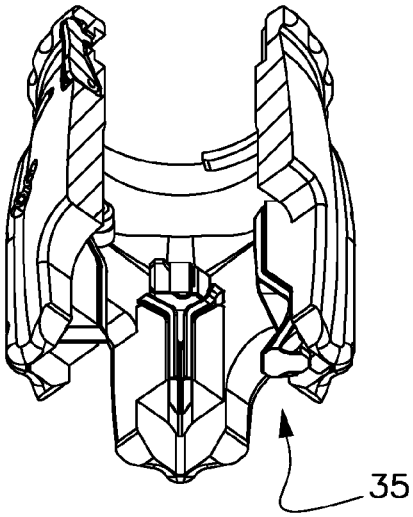
Fig.12
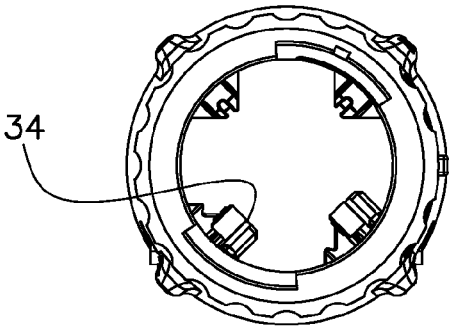
Fig.11c 250
54

240

260
442

200

200
34
54
T 54
2

261
23
34
400

200
261
34

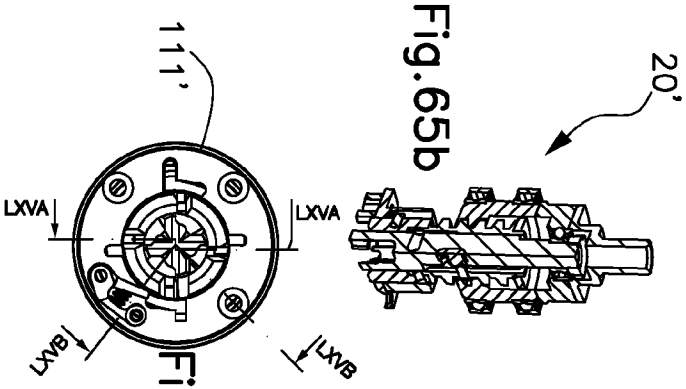
Fig.65b
Fig.65
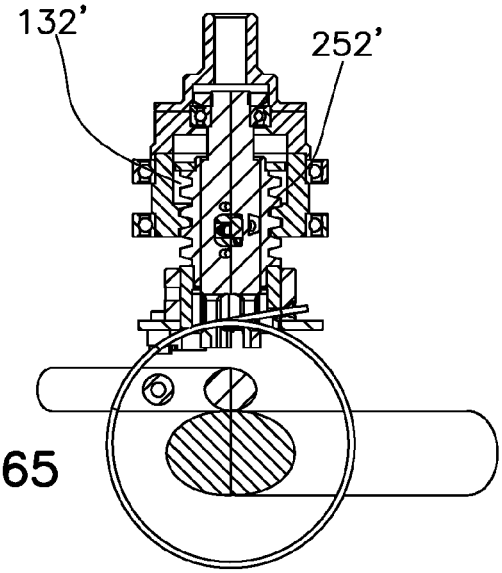
Fig.65a
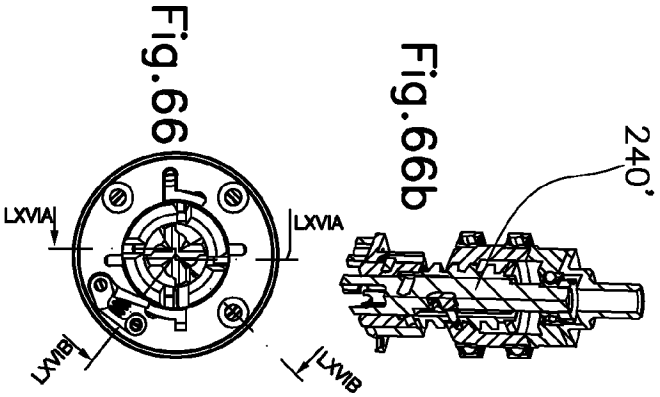
Fig.66b
Fig.66
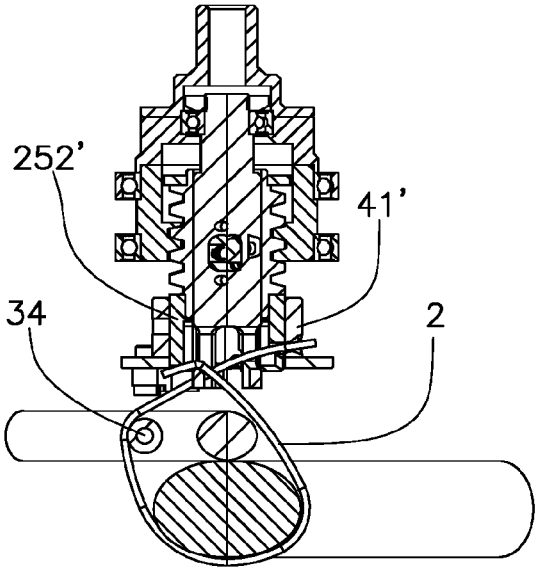
Fig.66a

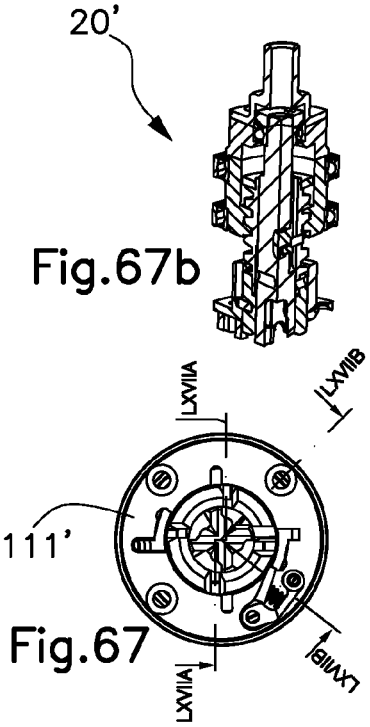
Fig.67b
Fig.67
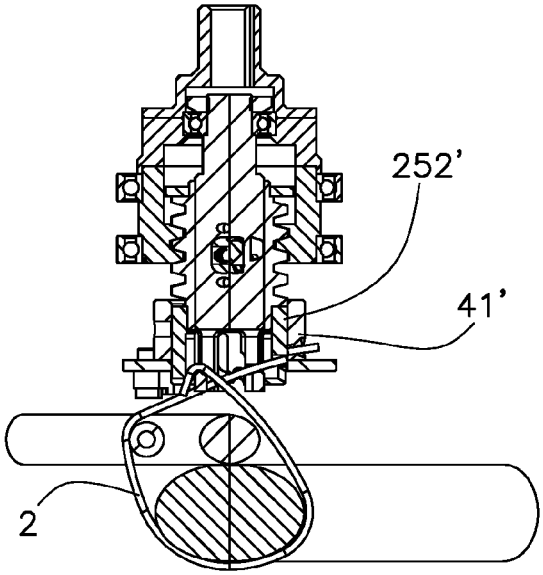
Fig.67a
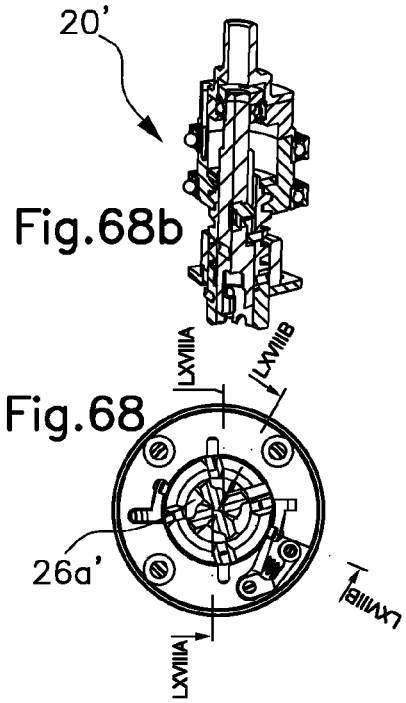
Fig.68b
Fig.68
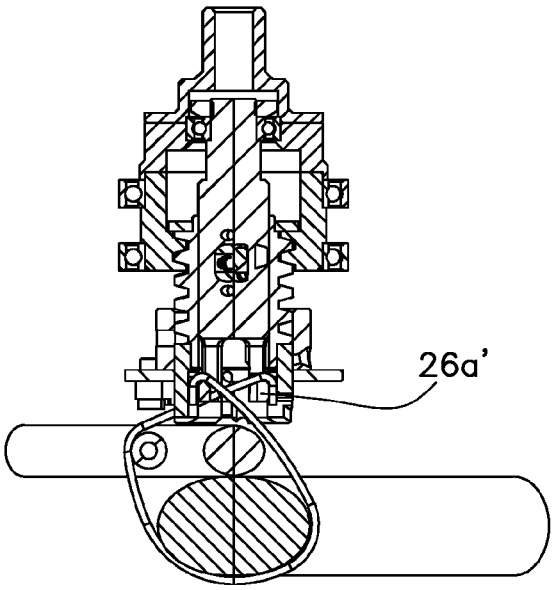
Fig.68a

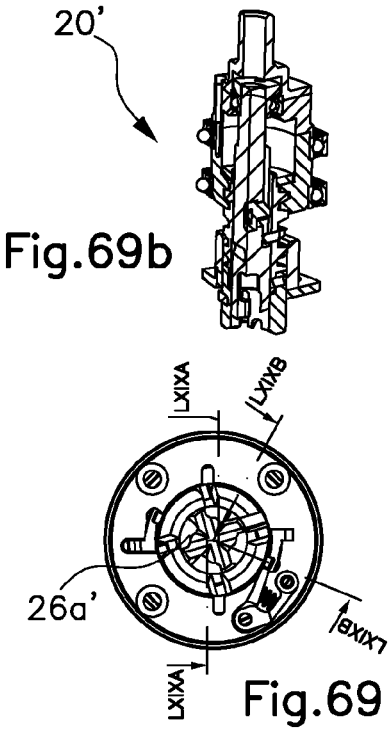
Fig.69b
Fig.69
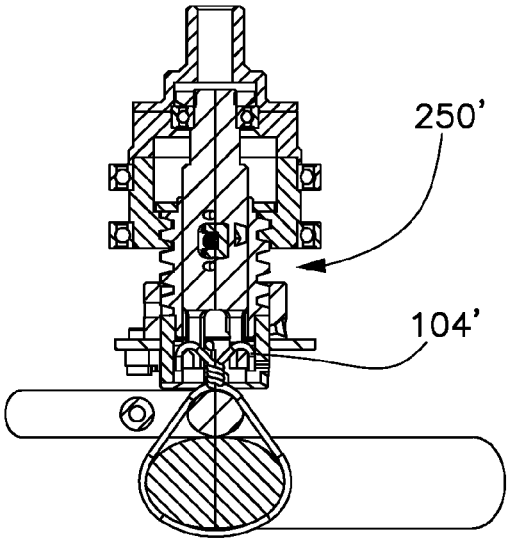
Fig.69a
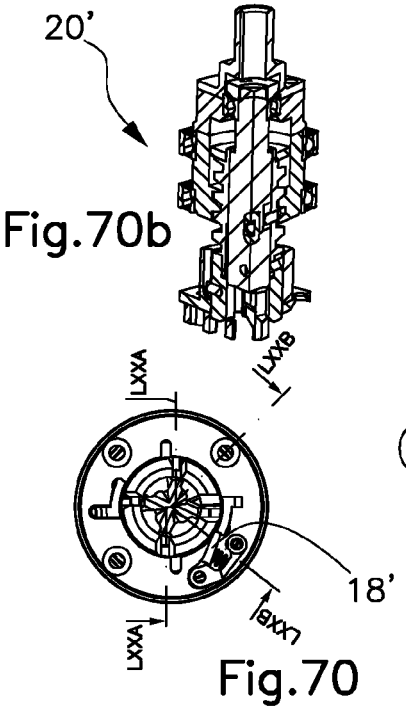
Fig.70b
Fig.70
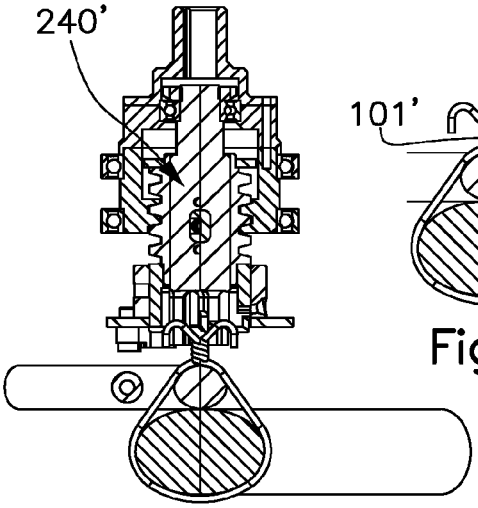
Fig.70a
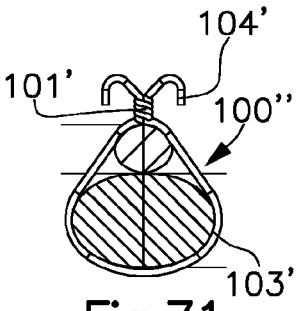
Fig.71

METHOD AND APPARATUS FOR BINDING METAL WIRES AND SIMILAR PRODUCTS

TECHNICAL FIELD

The present invention relates to a method, an apparatus for binding metal wires and similar products, as well as to a binding resulting, in particular, from the method object of the invention.

BACKGROUND OF THE INVENTION

Apparatuses that carry out binding of metal wires and similar products are known to the art, for example to create cages or metal reinforcing mesh for reinforced concrete, or protective mesh, fences suitable for use in different technical sectors.

The most widely used apparatuses are of the manual type, for example of the gripper type. Basically, the operator prepares a piece of metal wire around the area where the binding is to be performed, leaving the respective ends protruding on one side. The gripper member tightens the ends and then the operator twists them around themselves by rotation. The rotation may be semi-automatic, using a worm screw actuated by the operator and pulled back into position by elastic means.

Obviously, these manual apparatuses involve relatively long times for performing the binding, as well as high costs due to the significant use of labor.

In addition to this, it must be considered that the effectiveness, in particular the tension, of the binding carried out manually depends significantly on the manual skills and experience of the operator, however, the repeatability of the results is not guaranteed.

Automatic devices have recently been proposed for binding metal wires or similar products, which however are necessarily associated with dedicated and elaborate apparatuses, not always available or easily usable on building site.

Patent EP0751270 shows an apparatus for bending wires around reinforcement rod, that can be gripped by the operator. The apparatus comprises a feeding device, a guiding arm to guide the looped wire around the reinforcement rod, a twisting device to grip the looped part of the wire, twist and tighten it, a cutting device to cut the twisted portion from the base portion of the wire and a mechanism for positioning the starting end of the wire at a certain position to feed the apparatus with a new wire.

A different solution is illustrated in the patent EP1440746. The document discloses a machine for binding elements of reinforcement rod, adapted to feed a wire along a ring guide by means of a feeding assembly, to form a binding ring, and to twist the same ring so that the reinforcement elements are joined together. The machine includes a sleeve and fork-shaped members, associated with a shaft, comprising at the front, with respect to the direction of rotation, respective hooks for blocking the binding ring during the rotation of the shaft, thus causing the binding.

However, binding solutions known in the art do not meet the needs of the specific sector, in particular with regard to precision, strength of binding, costs and flexibility of use. In particular, the known solutions may be bulky or heavy, therefore not easy to insert inside the reinforcement rod or easy to handle, in order to perform the binding in any expected position.

More precisely, the specific sector complains of the need, not satisfied by solutions known in the art, of stably and uniformly tensioned bindings, which can therefore guarantee that certain safety standards are achieved and maintained in every phase of work.

In this regard, for example in the technical building sector, the need is felt for the joined elements to be mutually tightened and, therefore, immovable. This result is obtained only if the binding is adequately tensioned and strong. In fact, in this sector, once the reinforcement bar has been assembled, it is necessary to cast concrete on it. In the case, in particular, of floors, the operators usually carry out the distribution of concrete on the reinforcement rod, walking on it and using a delivery pump. The material to be dispensed, in fact, is of the pasty type, therefore not suitable for self-leveling.

During this step, the weight of the operator and his equipment can weigh on a single binding which, in order to withstand the effort, must be sufficiently strong and tight. In particular, the strength is commensurate with the transversal dimension of the wire used, while the level of tension is determined by the traction to which the wire is subjected following the binding process.

In case of insufficient tensioning and/or strength, the elements of the reinforcement rod are capable of moving, thus losing the configuration intended by the project. The displacement of the elements of the reinforcement rod may locally compromise the resistance parameters, in particular the moment of inertia, of the structural elements, for example beams and floors, provided for by the project. Furthermore, tensioning and sturdiness are important parameters in case of transport, when the bindings are made in the workshop and then moved to the construction site, in order to withstand, in particular, lifting and the inevitable bumps and jolts.

Bindings known in the art, made by hand, generally use wires with a maximum diameter of between 0.9 and 1 mm, which therefore can result in not sufficiently strong bindings.

On the other hand, conventional portable automatic devices use wires of a size comparable to those used for manual binding, or of a smaller diameter, for example between 0.6 and 0.8 mm, compensating for this dimensional reduction or, in any case, trying to strengthen the binding with the repeated winding of the same wire around the elements to be tightened. In such cases, however, the uniformity of wire tension is not guaranteed for each winding being made.

Finally, known automatic devices generally employ specially made reels of metal wires, therefore of a special type, non-refillable, and therefore expensive.

Patents EP 0757143 and U.S. Pat. No. 5,842,506 show further examples of automatic apparatuses for binding metal wires.

SUMMARY

The aim of the present invention is that of solving the cited problems, devising a method and an apparatus for binding metal wires and similar products, which enable strong and effective bindings.

Within the scope of this aim, a further object of the present invention is to provide an apparatus for binding metal wires and similar products, of simple constructive and functional conception, provided with safe and reliable use, and which is relatively inexpensive as well.

A further object of the present invention is to provide an apparatus for binding metal wires which is of flexible use, in particular which is easily adaptable to materials of different cross-sections.

Still further object of the present invention is to provide an apparatus for making a binding that is solid, effective and repeatable in a reliable manner.

The purposes described above are achieved, according to the present invention, by the method for binding metal wires of the present application, as well as by the apparatus for binding metal wires of the present application.

The method according to the invention for binding metal wires and similar products to a first element and a second element, in particular having an elongated shape, for example reinforcing rods, provides for preparing the first element and the second element in a superimposed crossed configuration, so as to define four respective quadrants at a crossing zone on a plane containing the longitudinal axis of one of the first element and the second element, and the projection of the longitudinal axis of the other one.

The method provides inserting a calendering assembly mounted around a binding axis in front of a binding apparatus, against at least one of the first element and the second element, at the crossing area, engaging the four quadrants with the respective winding prongs of the calendering assembly.

The method provides for feeding a wire and a further wire through the calendering assembly arranged at the crossing area, making by calendering a first winding, wound between two of the four said quadrants and having a first pair of opposite branches of the wire, and a second winding, wound between the remaining two of said four quadrants and having a second pair of opposite branches of the further wire, around the first element and/or the second element.

The method further provides for cutting, in an appropriate phase relationship, the wire and the further wire by means of a cutting assembly, thereby obtaining a respective pair of ends for each winding.

The method also provides for holding said ends of said first pair and said second pair of opposing branches by means of a binding head of the binding apparatus, mounted inside the calendering assembly and rotating around the binding axis.

The binding head is then rotated around the binding axis, to twist together the first pair and the second pair of opposing branches, held by said ends by the binding head, around the binding axis, obtaining an at least double binding around the first element and the second element, in which said opposite branches converge from each of said quadrants to said binding axis.

The step of feeding the wire and the further wire through said calendering assembly can provide for winding the wire and the further wire along respective mutually crossed winding paths around the first element and the second element, thereby making, following the step of operating the binding head, a double crossed binding around the first element and the second element.

According to a particular aspect, the step of feeding the wire and the further wire can provide for guiding the wire and the further wire along substantially parallel respective winding paths, separated from the crossing area, around one said element which, between said first element and said second element, is farther from the binding head when said calendering assembly is arranged in abutment. The step of operating the binding head thus achieves a double parallel binding around the first element and/or the second element.

The step of inserting the calendering assembly can provide for placing respective shaped recesses made in front of the calendering assembly against said first element or said second element.

The method preferably provides, in order to perform the calendering of the wire, for introducing the end of the wire along an input track, between the input track and a calendering roller, carried by the calendering assembly, and subsequently guiding the end of the wire along a return track also carried by the calendering assembly, the input track and the return track having for this purpose at least partially curved development.

Preferably, the wire is thrown between the input track and the return track, where "thrown" means that it is free for a respective intermediate portion between the first track and the second track.

Preferably, the thrown wire is guided in the second track through an initial portion having a shape of a guide, preferably an at least partially conical shape, in particular a funnel shape.

Any plane orthogonal to the binding axis is divided at the intersection area into four quadrants by the projections of the axes of the first element and the second element on the plane.

In other words, on a plane containing the axis of one between the first element and the second element and the projection of the axis of the other, four respective quadrants can be identified in the area of overlap and intersection of the elements. A quadrant is meant to be a portion of a plane.

The method can provide for winding the wire and the further wire along respective mutually crossed winding paths around the first element and the second element, thus performing a double crossed binding around the first element and the second element, following the step of performing the binding. More specifically, the method can provide for tightening, that is to bind tightly, the first element and the second element with the wire and the further wire, arranging the respective opposite branches to be twisted, each inside one of the four quadrants mentioned above.

According to this particular aspect, in the binding made in this way, the wire and the further wire have a single twisted portion in which at least the respective four ends, two of the wire and two of the further wire, converge, from the above-mentioned four quadrants. At the same time, the wound portion of the wire and the wound portion of the further wire are crossed. The method can provide in the same way for making a double parallel binding by guiding the wire and the further wire along respective winding paths, substantially parallel, separated by said overlapping or crossing area, around the element which, between the first element and the second element, is farther from the binding head when the apparatus is arranged in abutment, and by twisting the four branches of the wire and of the further wire.

According to this further particular aspect, in the binding thus created, the wire and the further wire have a single twisted portion in which at least the respective four ends, two of the wire and two of the further wire converge, from said four quadrants. At the same time, the wound portion of the wire and the wound portion of the further wire are substantially parallel.

The method preferably provides, in order to prepare the apparatus abutting against the first element, for moving the calendering assembly along a longitudinal axis of the apparatus near the first element and near the second element and for placing respective shaped recesses made in front of the calendering assembly abutting against the first element. This displacement in the longitudinal direction, made possible by the particular conformation of the calendering assembly, permits to easily reach and bind the elements arranged in any configuration, even uncomfortable for the operator. In particular, the wire can be thrown freely between the input track and the return track, leaving substantially free, therefore accessible, a respective front area of the calendering assembly, useful for moving near any type of element or overlapping of elements to be joined.

Preferably, the step of preparing the apparatus abutting against the first element is preceded by the step of orienting the apparatus and/or adjusting the longitudinal height of said shaped recesses.

The method may provide that at an early stage of binding, when the wire is tightened around the first element and/or the second element, if provided, the opposite branches of the wire, tangent to the first element or to the second element if provided, are arranged crossed, i.e. incident, forming a binding angle between them, which is a function of the overall dimensions of the element or elements to be bound and, preferably, of a distance between the binding head and the element or elements, the binding angle being between 70° and 135°, preferably between 90° and 110°.

Said distance may advantageously have a maximum value of 22 mm, preferably not greater than 18 mm.

According to a further particular aspect, the step of performing the binding can involve the separation of said residual portion from said twisted portion through a spontaneous cutting off of the twisted portion by twisting in an optimal position, as regards strength and height.

According to a further particular aspect, the ends of the wires of the binding are advantageously bent and may not be removed.

The apparatus according to the invention for binding metal wires and similar products around a first element and a second element superimposed and crossed at a crossing area comprises a body for receiving at least one unwinding wire and a further unwinding wire, a calendering assembly carried at the front by the body and arranged around a longitudinal binding axis, for guiding the wire and the further wire respectively in a first winding and in a second winding around the first element and/or the second element in a respective operating space of calendering defined within the calendering assembly, a binding head carried by the body along the binding axis, enclosed within the calendering assembly, for reciprocally twisting opposite branches of the wound wire and of the further wound wire, around said binding axis.

The calendering assembly for each winding comprises a respective fork comprising a first prong internally having an input track and a second prong internally having a return track opposite to the input track, with respect to the binding axis, so as to form a complete winding path for the wire and the further wire, a free area being interposed between the first and second prong of each fork, to throw the wire and respectively the further wire from the input track to the return track, to be wound around the first element and/or the second element (4).

The calendering assembly preferably forms a pair of said forks, comprising as many winding paths, respectively crossed or parallel, each for a respective said wire.

The prongs of the forks preferably have a substantially axial development, to allow the calendering assembly to be inserted in abutment with the first element and/or with the second element with a substantially axial movement.

The input track and the return track are preferably made by means of inserts, preferably of steel, applied to the calendering assembly.

The return track preferably forms one at least initial section in the form of a guide, to guide the introduction of the wire thrown from the input track.

The input track and/or the return track can at least partially form a groove to guide the wire during the winding around the at least one first element and/or during a progressive tightening around it.

Each wire calendering path inside the calendering assembly is preferably associated with at least one calendering roller, for example associated cantilevered at an initial section of the input track, to guide the wire.

The body preferably comprises a conduit for guiding the wire.

The conduit can advantageously comprise a rigid portion with curved development, for making a deformation corresponding to the wire and cancelling any pre-existing distortions.

The body can form at least one externally protruding wire guide shell, inside which said rigid portion for guiding the wire is made.

The wire guide shell is preferably in the form of a fin.

Preferably the body comprises a pair of wire guide shells, angularly spaced, for example by about 90°, around the binding axis.

The body preferably includes the handle, between the two wire guide shells, protruding from the body transversely, preferably substantially perpendicular to the binding axis. The arrangement of the handle can permit to grip the apparatus like a gun.

Said conduit internally defines a path for the wire, which extends for an initial portion in a direction substantially longitudinal to the binding axis up to a final portion oriented in a direction transversal thereto, in particular substantially perpendicular, through an intermediate portion having a curvature which aim is making a pre-calendering of the wire entering the binding head.

According to an aspect which can also be autonomous, therefore independent from the remaining features of the invention, a detached, fixed, trolley-mounted or suspended unit can be provided, or transportable for example on the shoulder or on a belt, for feeding the wire and, therefore, for housing at least one wire reel, which can be associated with the apparatus or other binding apparatus.

The detached unit may include, in particular house, moreover, preferably, at least one drawing and possibly straightening assembly for feeding the unwinding wire from the reel to the apparatus. This provision has the advantage of lightening the binding apparatus as well as enabling the feeding of wires of any diameter, without weight and size limitations, as well as housing a plurality of reels. Connection means for guiding the wire can then be provided.

The detached unit may include means for powering the apparatus, for example a battery, in particular if the unit can be carried on the shoulder or on a belt.

The apparatus according to the invention therefore allows strong and adequately tensioned bindings around at least one element and a second element to be bound to the first one, in an easy, repeatable and automatic way.

In addition, the apparatus enables a double binding that stabilizes optimally and maintains the overlapping configuration of the first element and the second element.

The apparatus according to the invention can be fed with a single wire or with two wires at a time, and be used to bind with two wires simultaneously, or selectively with a single wire between several wires, in particular two, fed to the device, in any case having the possibility of selectively binding with the one wire or with the further wire.

The binding according to the invention of a metal wire and of a further metal wire around a first element and a second element at a reciprocal crossing zone comprises a wound portion of the wire and a wound portion of the further wire, around the first element and/or the second element, and a single twisted portion made by the twisting of four opposite branches coming from said wound portions respectively of the wire and of the further wire, around the same binding axis. Said twisted portions converging towards the single twisted portion from each of the four quadrants of a plane orthogonal to the binding axis, delimited by the intersection of the longitudinal axis of one of the first element and the second element, and by the projection of the longitudinal axis of the other element.

According to a particularly advantageous aspect, the wound portions of the wire and the further wire develop between pairs of said opposite quadrants with respect to the binding axis, so as to form a corresponding intersection around the first element and the second element.

According to a particular aspect, the wound portion of the wire and the wound portion of the further wire are arranged so as to be substantially parallel and separated from the crossing area, tightened around the first element and the second element.

According to a particular aspect, at least one of the wire and the further wire has a transverse dimension between 1 and 3 mm.

The diameter or the transversal dimension of the wire and the further wire, used simultaneously for binding, can be different from each other.

BRIEF DESCRIPTION OF DRAWINGS

The details of the invention will become more evident from the detailed description of a preferred embodiment of the apparatus for binding by means of metal wires and similar products according to the invention, illustrated by way of example in the accompanying drawings, wherein:

FIGS. 1*a*, 1*b* are a perspective view from respective angles of the apparatus according to the invention, arranged at respective overlapping portions of elements to be bound;

FIG. 1*c* is a perspective view of the same apparatus, from a further angle, without elements to be bound;

FIGS. 9*a*, 9*b* and 9*c* are a perspective view, from different angles, of the same detail illustrated in FIG. 8;

FIGS. 11*a*, 11*b*, 11*c* are respectively a perspective view, a side view and a plan view of a calendering assembly used in the same apparatus;

FIG. 12 is a partially sectioned view along a pair of axial planes of the same calendering assembly;

FIGS. 64, 64*a* and 64*b*, 65, 65*a* and 65*b*, 66, 66*a* and 66*b*, 67, 67*a* and 67*b*, 68, 68*a* 68*b*, 69, 69*a* and 69*b*, 70, 70*a* and 70*b* are respectively the same views illustrated in the FIGS. 63, 63*a* and 63*b*, in subsequent operational steps; and FIG. 71 is a view in a section corresponding to the section illustrated in FIG. 70*a*, of a binding released from the same binding head.

DETAILED DESCRIPTION

With particular reference to the figures, 1 indicates the apparatus for binding metal wires 2 and similar products, wound around a first element 3 and, preferably, a second element 4, in particular having an elongated shape, for example elements of reinforcement rod (see FIG. 1*b*).

The apparatus can be further used for different purposes, for example for binding an identification tag to an element or simply for closing a single element, for example of deformable material, such as the end of a bag.

Figure 4:
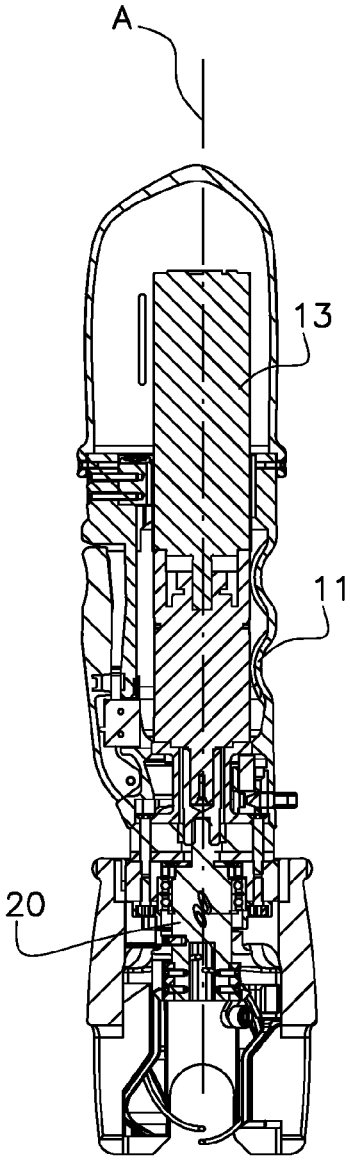
FIG. 4 is a sectional view, according to the line IV-IV indicated in FIG. 3, of the apparatus according to the invention.

The apparatus 1 according to the invention is suitable for making any type of binding, for example simple or double, crossed or parallel, in any case by twisting the wire-like material around the same binding axis A (see FIG. 4).

It is understood that each reference hereinafter to a wire 2 can also be understood as a reference to the provision of several wires 2, for example, as in the case of, but not limited to, a pair of wires 2, a wire 2 and a further wire 2, for making a double crossed or parallel binding, as described in particular below. The same is true, where feasible, for the opposite case.

The apparatus 1 is therefore capable of joining by binding the first element 3 and, preferably, the second element 4 at an area of mutual overlap or intersection.

The first element 3 and the second element 4, to be joined by binding, may for example comprise longitudinal metal elements to be bound at junctions or overlaps, or longitudinal and transverse metal elements to be bound at crossings, respectively, intended for making metal cages or wire mesh for the reinforcement rod of building structures, for fences or for other purposes. For example, the elements to be joined may comprise a longitudinal element, such as a reinforcement bar and, preferably, a transverse element, such as a reinforcement bracket, for making building structures of reinforced concrete.

In particular, the transverse element can be either flat or curved, single or double. More precisely, in a reinforcement cage, for example, the transverse elements are usually brackets curved on themselves, in which the respective ends are superimposed and placed side by side, thus giving rise to the overlapping of terminal portions which therefore constitute double elements, to be bound to a longitudinal element, usually a bar, for reinforcement. It is also observed that in reinforcement cages, the longitudinal reinforcing elements can cross the transversal elements, the brackets, both on the sides of these, causing flat crossings, and on the curved portions, the edges of these, determining in the latter case three-dimensional crossings.

The elements to be bound can have transverse dimensions, in particular diameters, which vary within a wide range, in particular as known in the technical field of reference.

Figures 28, 29A, 29B, 30A, 30B:
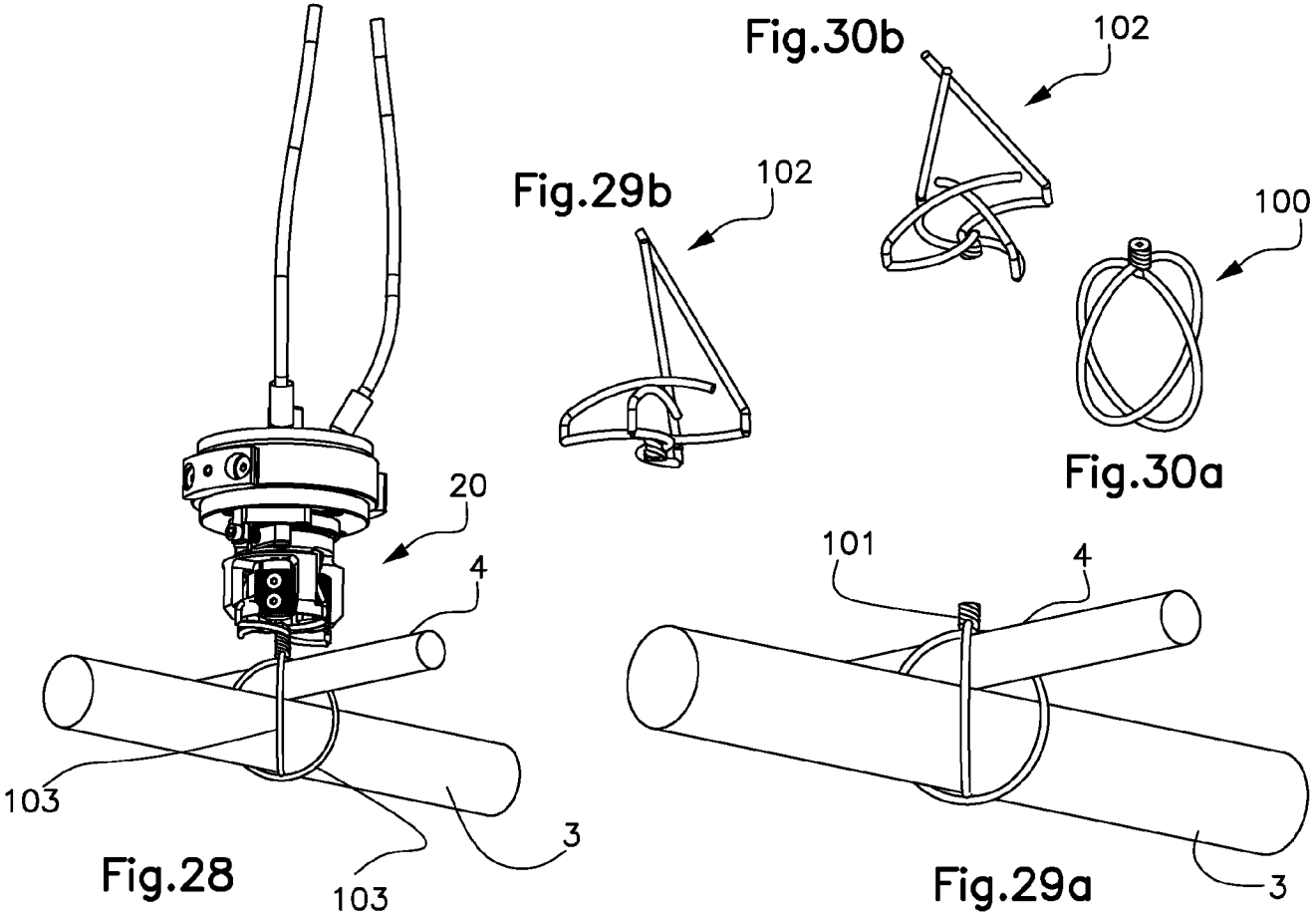
FIG. 28 is a perspective view of the binding head, of the binding material and of a pair of elements to be bound in a final binding step.
FIGS. 29*a* and 29*b* are respectively a perspective view of the binding carried out around the same pair of elements and of a portion of the wire of the binding separated from the binding carried out.
FIGS. 30*a* and 30*b* are respectively a perspective view only of the binding carried out and of the portion of material or wire of separate binding.

"Binding" means the product of the helical winding along the binding axis A, of opposing branches 2' of the wire 2, which is wound around the first element 3 and/or the second element 4, until, according to the requirements of use, the area of mutual overlapping of the elements to be joined is tightened (see for example FIG. 28).

The wires 2 can be unwound from respective reels 5 using special unwinding means. Preferably the wires 2 are wires of annealed metal material, in particular specific for bindings, which has an accentuated moldability. Advantageously, the equipment according to the invention can use most of the wires commonly available on the market.

Figure 2B:
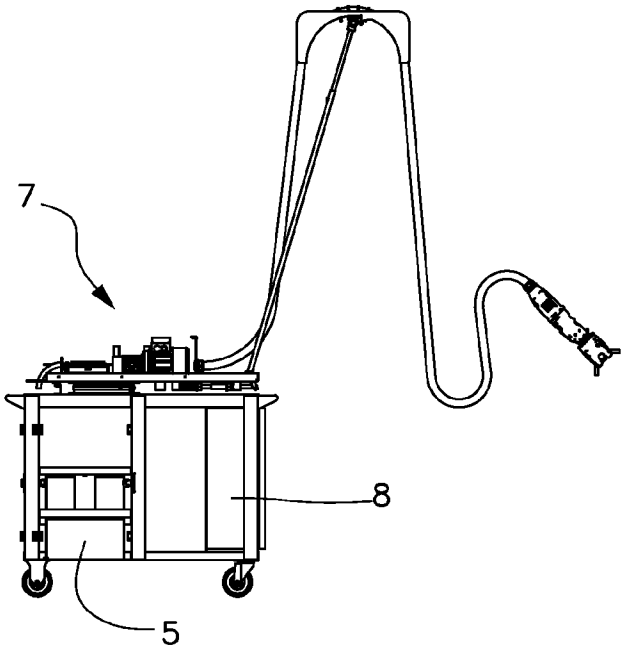
FIGS. 2*a* and 2*b* are respectively a perspective view and a side view of the same apparatus associated with a detached feeding unit.
Figure 2A:
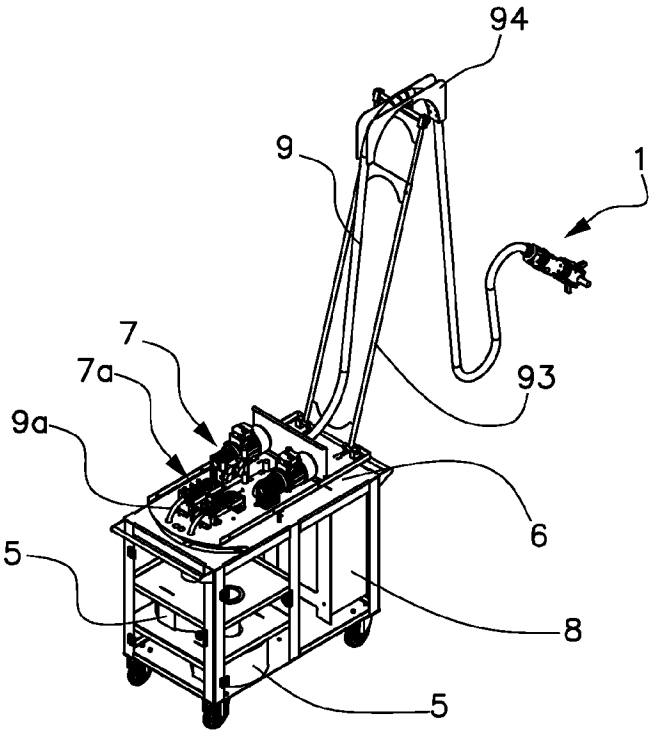

For example, at least one reel 5, preferably a plurality, for example a pair of reels 5, can be arranged separately from the apparatus 1, for example on a detached unit 6 (see FIGS. 2*a* and 2*b*).

The detached unit 6 can be used to serve binding apparatuses of different types, also different from the apparatus object of the invention, thus lightening the weight of these ones and allowing the feeding of wires of considerable transversal dimension, otherwise not easily housed, for size and weight, on the apparatus.

Preferably the detached unit 6 can be wheeled, provided with wheels or tracks, suspended or equipped in an equivalent way, to be easily moved near the place of use. Alternatively, the detached unit 6 can be carried on the shoulder, such as a backpack, or on a belt.

On the detached unit 6 a drawing assembly 7 can then be further housed as an unwinding means for each reel 5. The drawing assembly 7 can optionally be associated, in particular preceded, according to a feeding direction, by a straightening assembly 7*a* of the wire 2 unwound from the reel 5.

The detached unit 6 can further include a control device 8 to ensure the electricity supply to the apparatus 1, possibly with the aid of a battery, as well as the coordination of the feeding operations to the apparatus 1 of the wire 2 or of the wires 2, as appropriate. More precisely, the control device 8 is configured to control the drive means of the drawing assembly o assemblies 7, as well as the drive means arranged inside the apparatus 1, as described in detail below.

Connection means 9, for example of the tubular and flexible type, in particular in the form of sheaths, can be provided, to enable the electrical connection and the feeding of the wires 2 from the detached unit 6 to the apparatus 1.

The tubular connection means 9 can house, for example, sheaths 90 for passing the metal wires 2, a power supply and control cable 91 for the actuation means of the apparatus 1 and an electrical signaling cable 92 to carry the necessary electrical signals to the control means of the apparatus 1, as described below (see in particular FIG. 3).

In particular, the connecting means 9, for example a flexible tube, can be supported by an arm 93 carried by the detached unit 6, to raise the means. The arm 93 can preferably carry at the top a housing guide 94, to receive the connecting means 9, in particular the flexible tube, arranging them according to a curved path.

Further connection means 9*a*, for example of the rigid tubular type, can be provided to guide the wires 2 from the respective reels 5 to the drawing and possibly straightening assemblies 7, 7*a*, if provided.

Figure 2C:
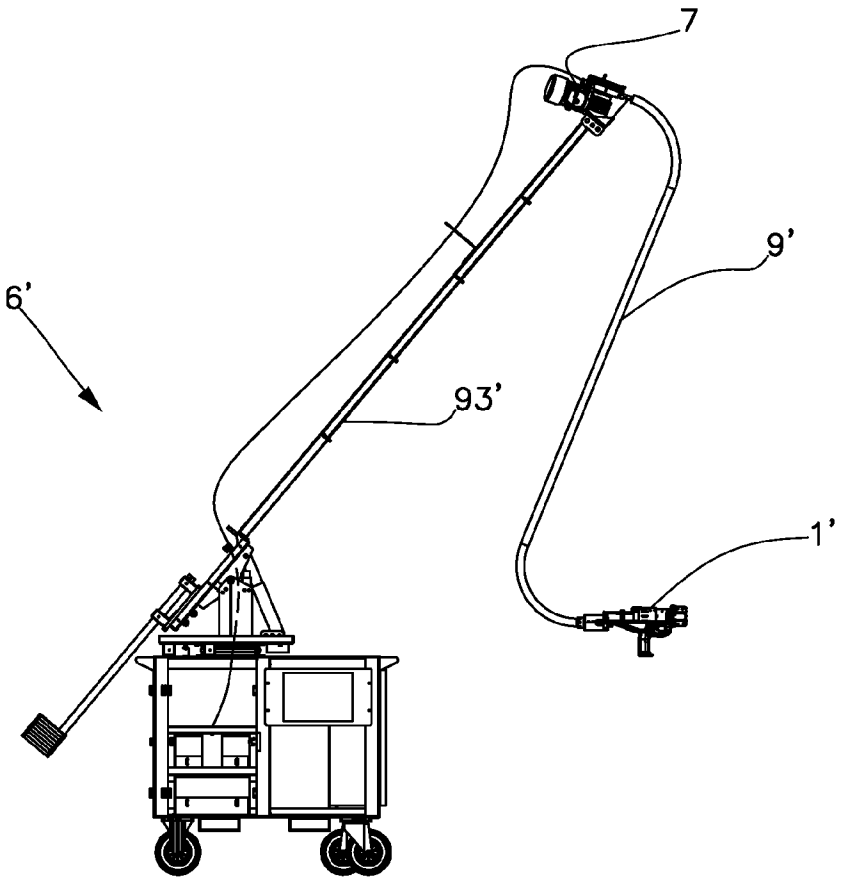
FIG. 2*c* is a side view of a different embodiment of the apparatus associated with a different detached unit.

According to a further embodiment illustrated in FIG. 2*c*, the detached unit 6' can provide for housing the drawing assembly 7 at the top of the arm 93'. This provision allows to shorten the connection means 9' by maximizing the available drawing force and thus allowing the binding apparatus to work better and be able to keep it further away from the detached unit 6'. In FIG. 2*c* the detached unit is connected to a further embodiment of the apparatus 1', described below, but may be connected to any binding apparatus.

The detached unit 6, 6' can usefully comprise an anti-return device 60 of the wire 2 (see FIGS. 39 and 40), configured to prevent that in the operations in which the wire 2 is pulled back by the respective drawing assembly 7, as described in detail below, the wire 2 is rewound in a disorderly manner in the respective reel 5. In particular, especially when the reel 5 is close to an exhaustion step, gradually emptying itself when it is fed in the thrust direction S, the return of the wire 2 in the opposite direction R may be a problem. In fact, if in the returning step the wire 2 insinuates itself inside the reel 5, this return risks forming a loop of wire 2, which can become tangled with some free turns of the reel 5.

The anti-return device 60 serves to prevent the wire 2 already unwound from re-entering the reel 5. In particular, thanks to the anti-return device 60, the wire 2 completes an alternative path, in particular in the shape of an S, partially inside guide means 61 which can move alternately between a thrust configuration 61*a* and a return configuration 61*b*. The guide means 61 can usefully be made up of, at least partially, a return spring through which the wire 2 can be guided.

The anti-return device 60 of the wire 2 can be associated with means 62 for inserting the wire 2 coming out of the reel 5, aimed at ensuring its correct guide.

In particular, in order to avoid the disordered return of the wire 2 into the reel in the returning step, the thrust configuration 61*a* can correspond to a path stretched towards said insertion means 62, if provided, interposed between the reel 5 and the anti-return device 60, while the return configuration 61*b* can correspond to a loose path, for example a loop, external to the reel 5.

Figure 40:
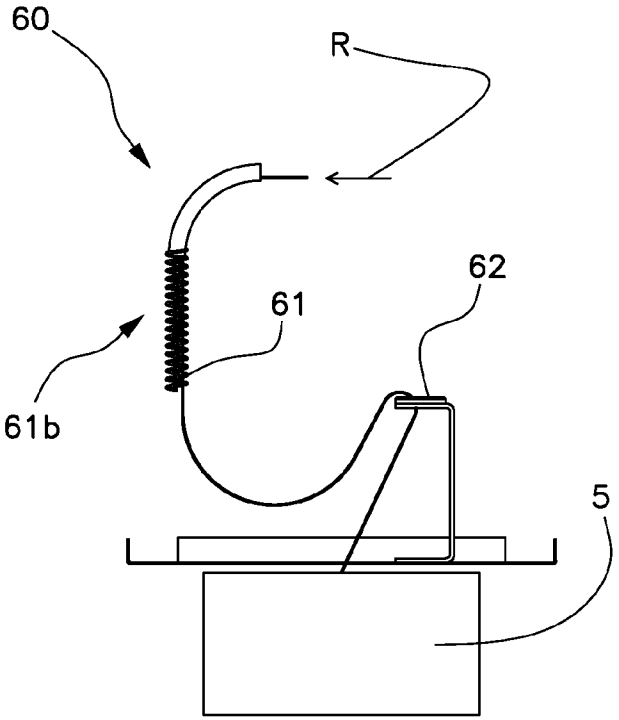
FIGS. 39, 40 are a schematic side view of a detail of a detached unit for feeding the wire to the apparatus according to the invention, in different operating steps.
Figure 39:
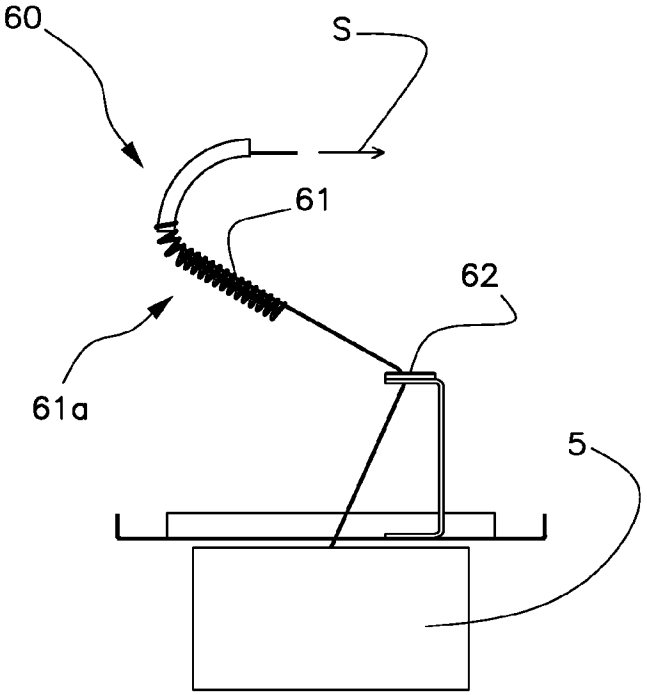

The guiding means 61 are therefore arranged in the thrust configuration 61*a* when the wire 2 is fed in the thrust direction S and in the return configuration 61*b*, when the wire is pulled back in the return direction R (see FIGS. 39 and 40).

The detached unit 6, 6' can also provide, alternatively, to house portable power supply means, for example battery-powered, for powering the apparatus. This provision is particularly useful in the event that the detached unit 6 is transportable on the shoulder or on a belt.

The apparatus 1 preferably shapes a portable unit, therefore a portable tool, advantageously light and compact, easily maneuverable by an operator (see in particular FIGS. 1*a*, 1*b*, 1*c*).

In a very versatile way, the apparatus 1 can be mounted on an automatic machine, for example a machine for making metal cages, an assembler or a machine for making metal meshes or be on a robotic arm, instead of being gripped by a operator.

Figure 3:
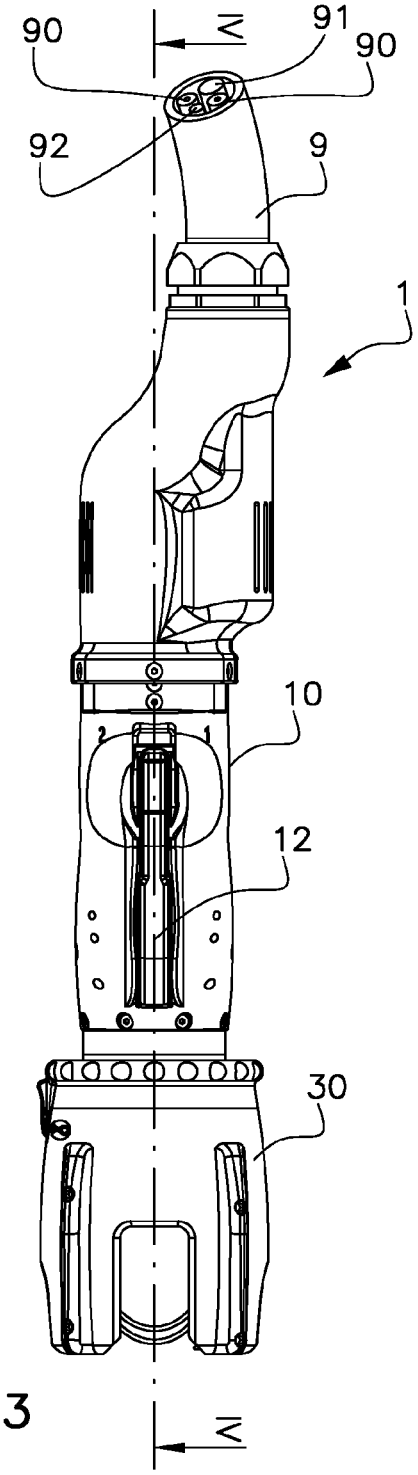
FIG. 3 is a side view of the same apparatus.
Figure 6:
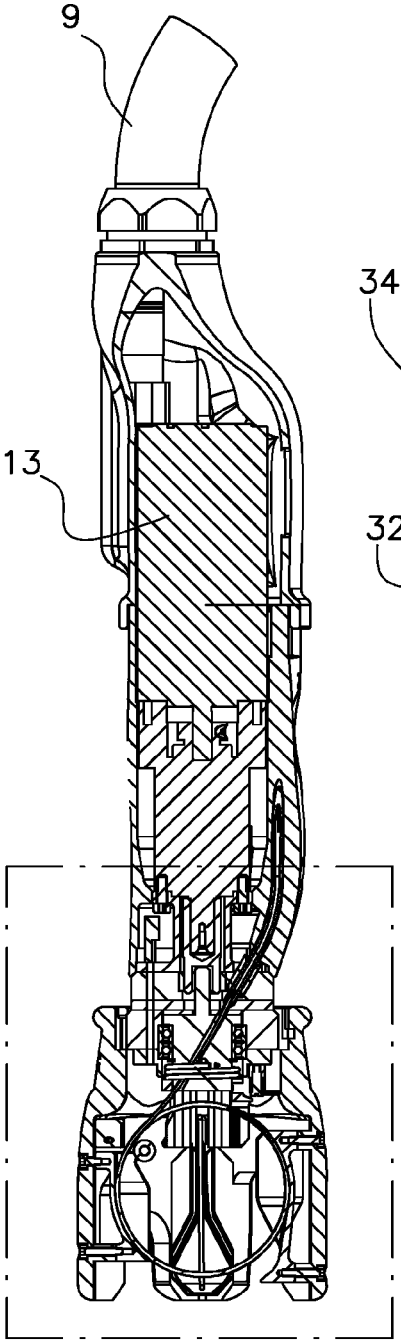
FIG. 6 is a sectional view of the apparatus according to the invention, according to the median axial plane of line VI-VI indicated in FIG. 5.

The apparatus 1 therefore comprises a body 10, preferably grippable by the operator, a binding head 20 connected to the body 10 and rotatable around the binding axis A, and a calendering assembly 30 cooperating with the binding head 20 for winding and binding at least one wire 2 around the first element 3 and/or the second element 4 if provided (see, in particular, FIGS. 3 and 4).

The calendering assembly 30, in particular, can also usefully perform the function of enabling the support, therefore the reference, also adjustable, of the apparatus 1 on the elements 3, 4 to be bound, such that these ones are in the correct positions to be then wound by the wires 2. In particular, this support can contribute to determining a correct binding angle β, as described below.

Figure 15:
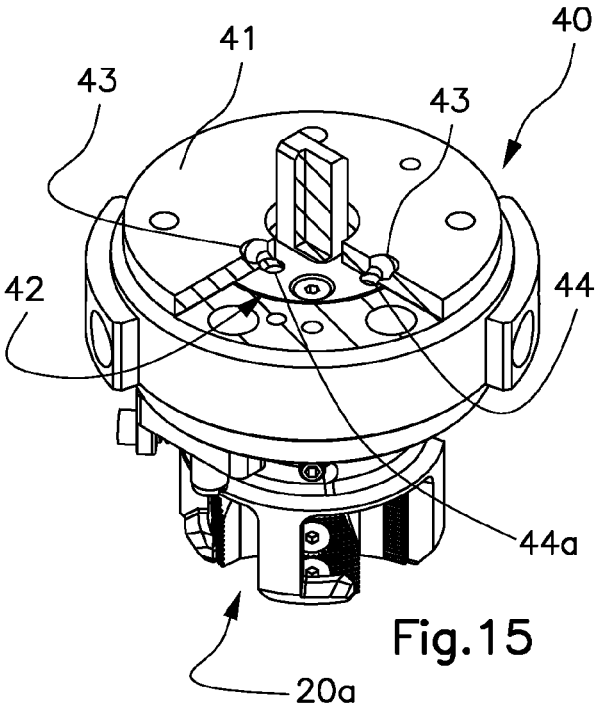
FIGS. 14 and 15 are respectively a section view according to the trace of plane XIV-XIV indicated in FIG. 13 and a partially sectioned view according to a pair of incident axial planes, of a detail of a binding head used in the apparatus according to the invention.

The apparatus 1 further comprises a cutting assembly 40, to shear each fed wire 2 (see in particular FIG. 15).

The body 10 preferably comprises a handle 11 to facilitate gripping by the operator and a control member 12, preferably an activation lever or trigger, to activate the binding cycle or a phase thereof, as described in detail below. Alternatively, the control member can be made by means of a contact or proximity sensor, configured to automatically activate the binding cycle, for example, when the apparatus reaches the stop, that is, against the elements 3, 4 to be bound.

More precisely, the control member 12 preferably activates both a binding cycle and an unloading cycle. The binding cycle can include feeding and calendering, cutting and binding the wires 2. An unloading cycle may be provided, which may include the expulsion of the fragments of wires 2 remaining in the binding head 20 and the rearrangement of the mechanism, that is, of the binding head 20, in an initial position, as described in detail below. The body 10 preferably has a substantially longitudinal development along the binding axis A. This development has the advantage of optimizing the transverse dimensions of the apparatus 1, allowing frontal insertion, which is effective even in difficult to access work positions, as well as useful when, for example, the apparatus is mounted on a machine. The body 10 can also take on a different shape, for example as described below, as long as it enables the operator to work in the most ergonomic position possible for the specific use. However, different arrangements are possible, as illustrated below.

The body 10 houses a actuation member 13, in particular a gearmotor, to rotate, upon activation of the control member 12, the operating members of the apparatus 1, to operate the binding steps.

The actuation member 13, in particular, is preferably configured to control the rotation both clockwise and counterclockwise and thus to activate all the movements of the binding head 20 and, preferably, of the cutting assembly 40.

The actuation member 13 preferably comprises means for detecting the angular position, for example an electric transducer, such as an absolute encoder, or mechanical one, such as a stop system and/or interlocking means, to ensure the correct angular positioning of the relative moving parts, as described in detail below.

Figure 10A:
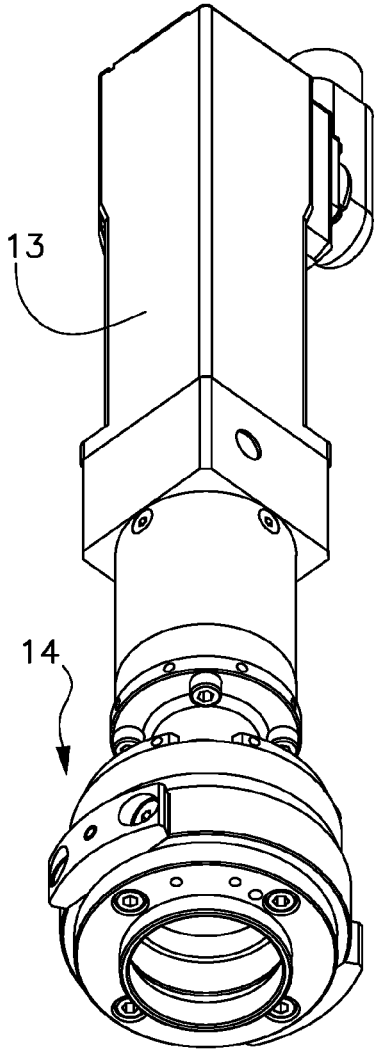
FIGS. 10*a*, 10*b* are a perspective view, respectively from different angles, of the body of the apparatus according to the invention, without a cover casing.
Figure 10B:
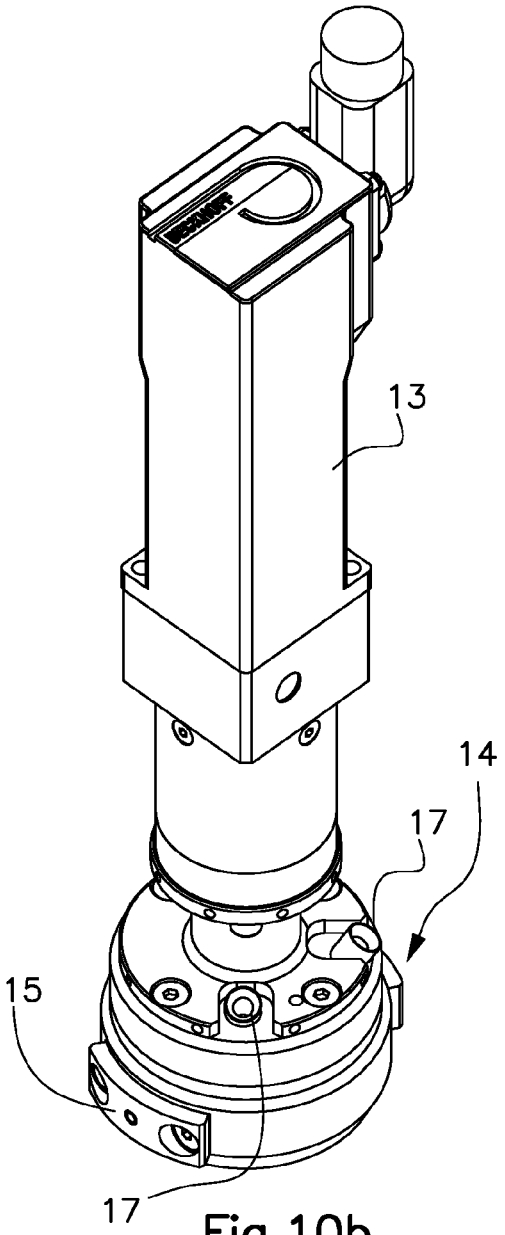
Figure 13:
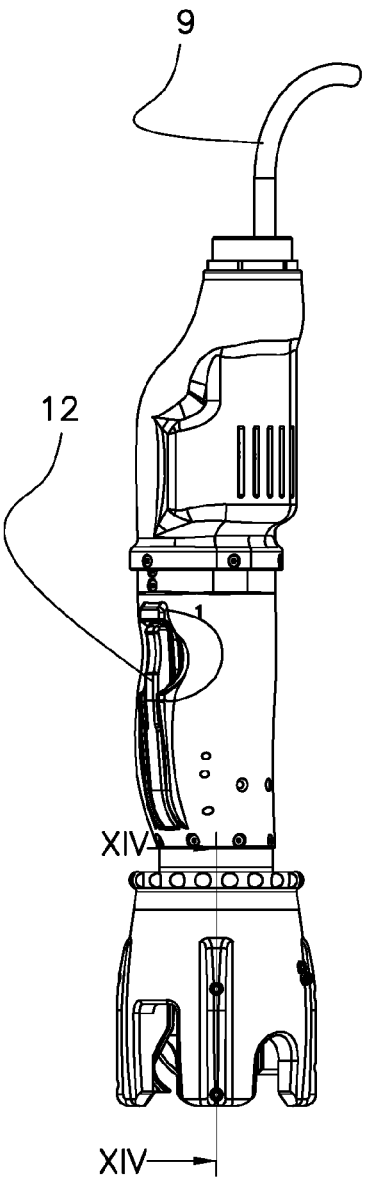
FIG. 13 is a side view of the apparatus according to the invention.

The body 10 further comprises a connection portion 14 for connection to the binding head 20 and to the calendering assembly 30 (see in particular FIGS. 10*a* and 10*b*).

Preferably, the connection portion 14 can preferably carry means 15 for attachment to the calendering assembly 30, preferably of the quick-coupling type (see FIGS. 10*a* and 10*b*). The attachment means 15, in particular the rapid one, permit to intervene quickly on the apparatus 1, for example in case of a jam and, especially, allow the calendering assembly 30 to be replaced just as quickly, if, for example, the dimensions of the elements 3, 4 are such as not to be included in the interval covered by the assembled unit, in particular for optimal support, or if it is necessary to change the type of binding, in particular double crossed or parallel one, as illustrated below.

Figure 7:
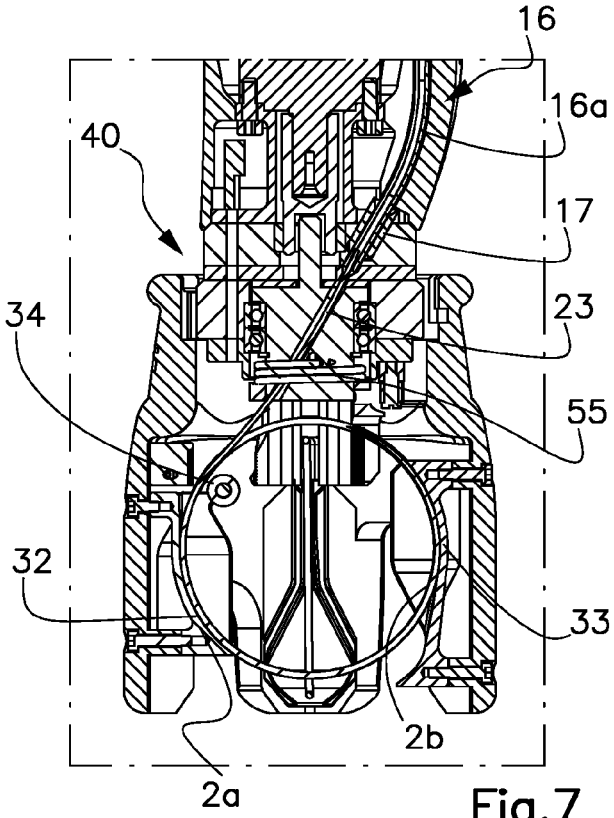
FIG. 7 is an enlarged view of a detail illustrated in FIG. 6.
Figure 5:
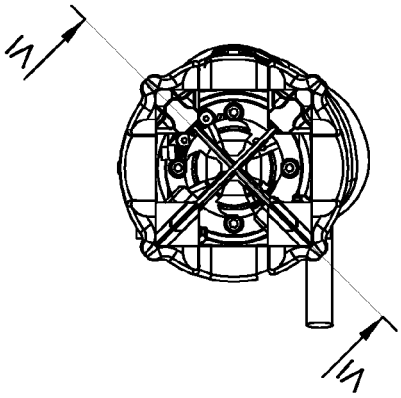
FIG. 5 is a plan view, from below, of the same apparatus.

The body 10 also includes a conduit 16 for feeding the wire 2 unwinding from the reel 5 (see FIG. 7). In the illustrated case, suitable for making a binding with a first and a second wire 2, i.e. double, the body 10 houses a pair of conduits 16. Each conduit 16 includes at least one rigid portion 16*a*, for example terminal, to correctly guide the wire 2 coming from a longitudinal end of the body 10 to the opposite end, towards the binding head 20.

The conduits 16 are oriented inside the body 10 according to a variable inclination, from a substantially longitudinal input orientation to an inclined output orientation, preferably at an angle of about 30° with respect to the binding axis A, so as to ensure correct insertion inside the binding head 20 and the calendering assembly 30.

Preferably, the rigid portion 16*a* of the conduit 16 forms an accentuated final curve. This curved conformation is particularly useful in the case when a wire 2 of annealed material is used. This type of wire 2, in fact, being characterized by a high capacity of non-elastic deformation, can easily assume the configuration imposed by the preferably accentuated curvature of the terminal portion 16*a*.

The effect produced by the terminal portion 16*a* consists in "erasing the memory" stuck in the wire 2 by the path through the flexible connection means 9, to lead it to the binding head 20, with precision, both in the orientation and in the spatial arrangement.

The conformation of the terminal portion 16*a* of the channel 16 thus allows the wires 2 to exit substantially in the same way regardless of the position assumed in the space by the apparatus 1 and the connection means 9.

Furthermore, the terminal portion 16*a* can also play a role in a rearrangement step of the wire 2 after a binding cycle. More precisely, when the operator moves the apparatus 1 in the space, to reach the elements 3, 4 to be joined and to position the apparatus 1 correctly, this determines corresponding deformations of the portion of wire 2, housed inside the terminal portion 16*a*, with respect to the portions housed inside the deformable parts of the conduit 16. To cancel these deformations it is therefore advantageously sufficient to pull back the wire 2 upstream of the terminal portion 16*a* of the conduit 16.

The conduits 16 are preferably housed at least in part at the handle 11, to allow a progressively inclined path, from the entrance to the exit from the body 10, towards the binding head 20.

Each conduit 16 preferably flows into a mouth 17 arranged at said connection portion 14, preferably suitably inclined with respect to the longitudinal axis of the apparatus 1, in particular coinciding with the binding axis A, corresponding to the aforementioned terminal portion 16*a*. In the illustrated case, the connection portion 14 comprises a pair of mouths 17 spaced angularly, preferably at an angle equal to 90°, and preferably inclined with respect to the binding axis A, to guide the fed wire 2 in a corresponding manner (see FIGS. 7 and 10*b*).

Figure 17B:
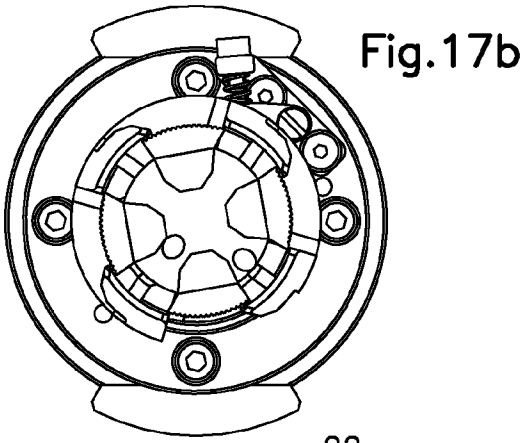
FIGS. 17*a*, 17*b*, 17*c* are respectively a perspective, plan and side view of the same binding head in an operative configuration.
Figure 17C:
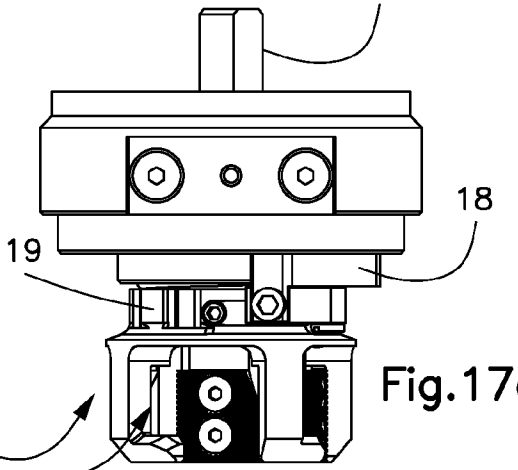
Figure 17A:
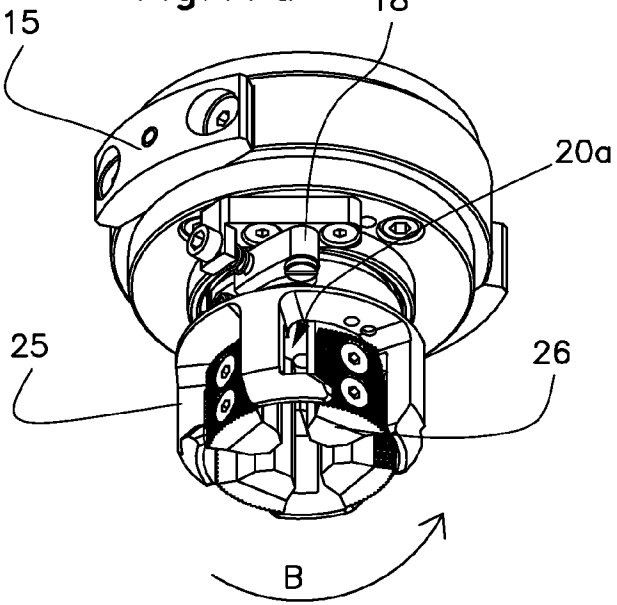

Furthermore, the same connection portion 14 carries, on the side facing the binding head 20 in use, a rearrangement mechanism 18, for rearranging the binding head 20 at the start of a new binding cycle (see for example the FIG. 17*a*).

The rearrangement mechanism 18 performs the function of placing the binding head 20, normally placed in a retention configuration by the contrast action preferably carried out by elastic means, in an open configuration. This permits, for example, to prepare the beginning of the binding cycle, but also to facilitate the unloading of wire fragments 2 remaining in the binding head 20 at the end of the cycle. The rearrangement action is performed by rotating the binding head 20 up to an advanced angular position with respect to an initial reference position. As previously mentioned, the rearrangement mechanism 18 can be associated with means, for example electrical or mechanical, for detecting the angular position.

More precisely, the rearrangement mechanism 18 can be made by means of a lever articulated to the connection portion 14, opposed by elastic spring means, the lever being shaped and arranged for use, so as to engage a respective coupling cavity 19 made on the binding head 20, as described in detail below (see FIG. 8).

The binding head 20 is preferably mounted in front of the body 10, coaxially with the calendering assembly 30. In particular, the binding head 20 is preferably inserted inside the calendering assembly 30.

The binding head 20 includes a support member 21 bearing a keying portion 22 for attaching to the drive member 13, preferably made in the form of a tang.

Figure 14:
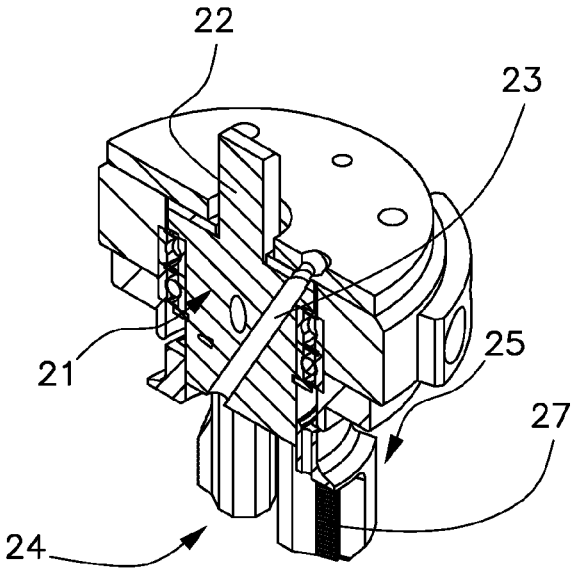
Figure 16:
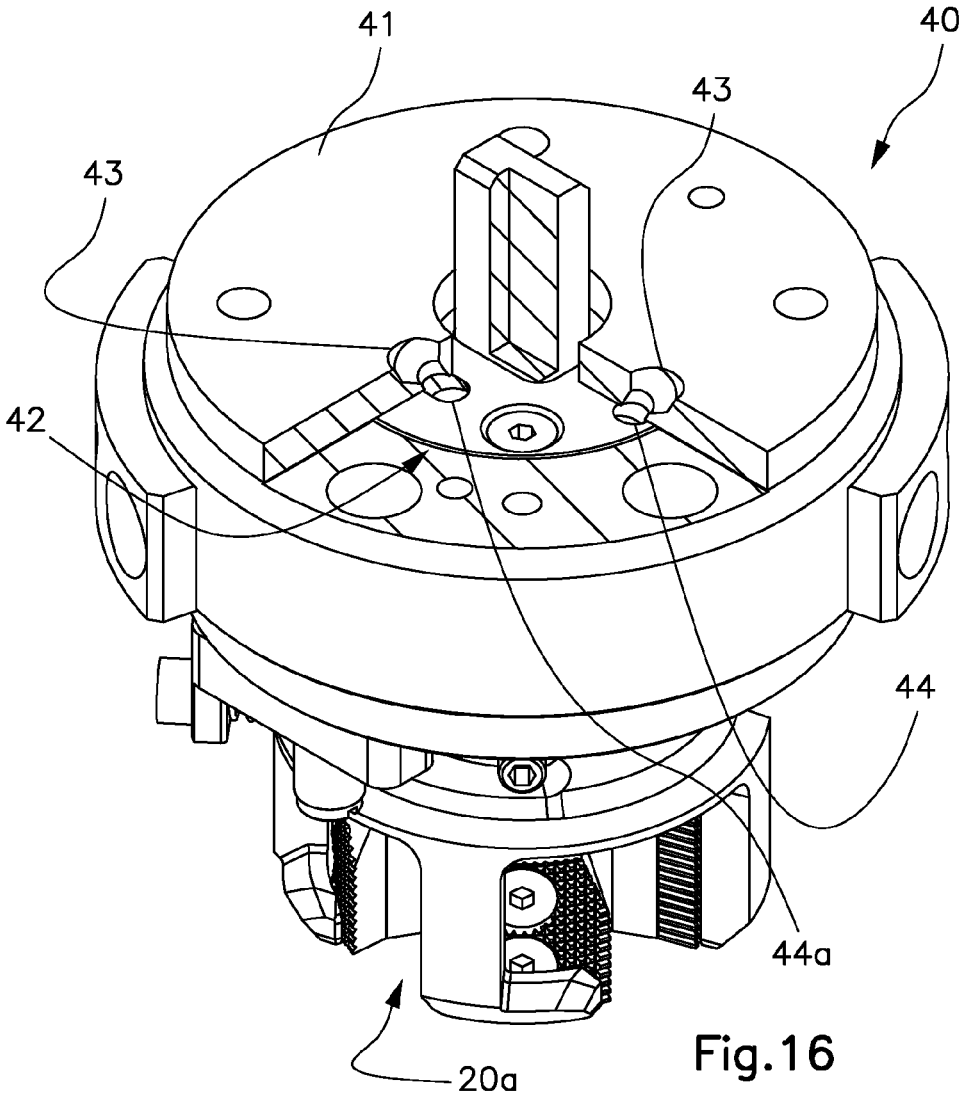
FIG. 16 is an enlargement of FIG. 15.

The support member 21 also has a channel 23 for the passage of each fed wire 2, which extends through the cutting assembly 40, as described below, starting from the respective mouth 17 and opens at the opposite end (see FIG. 14). In the case illustrated by way of example, two angularly spaced channels 23 are provided on the support member 21.

Preferably each channel 23 extends inside the support member 21 in an inclined way with respect to the longitudinal axis of the member itself, coinciding with the binding axis A. Basically, the channel 23 continues the inclination assumed by the mouths 17, for the correct insertion of the wire 2 in the binding head 20 and in the calendering assembly 30.

At the opposite end, the binding head 20 comprises a first operating member 24 (see FIG. 14) and a second operating member 25 (see FIG. 17*a*), cooperating to hold each wire 2 and twist it around the binding axis A.

More precisely, the first operating member 24 comprises a plurality of fingers 26 arranged peripherally and angularly spaced around the binding axis A. Each finger 26 preferably develops in a substantially longitudinal way and preferably provides a decreasing cross section towards the binding axis A, to facilitate the insertion and sliding of one wire 2 between adjacent fingers 26.

Figure 27:
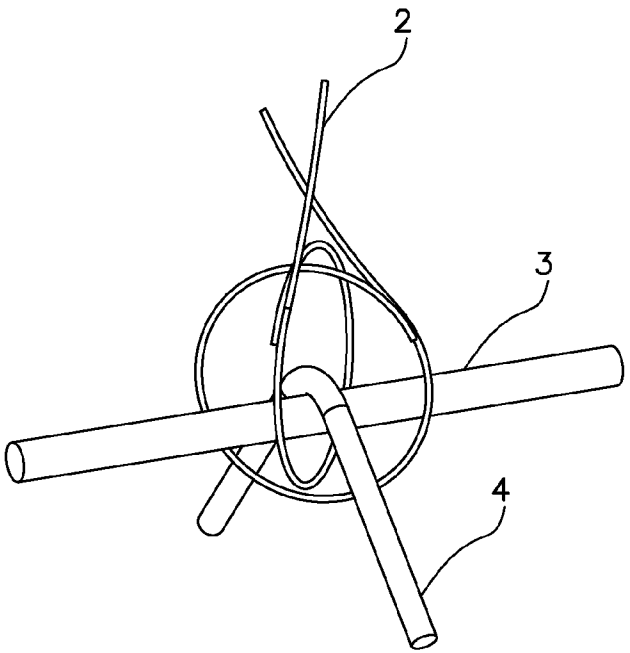
FIGS. 26 and 27 are a binding wire wound around respective different types of elements to be bound.
Figure 26:
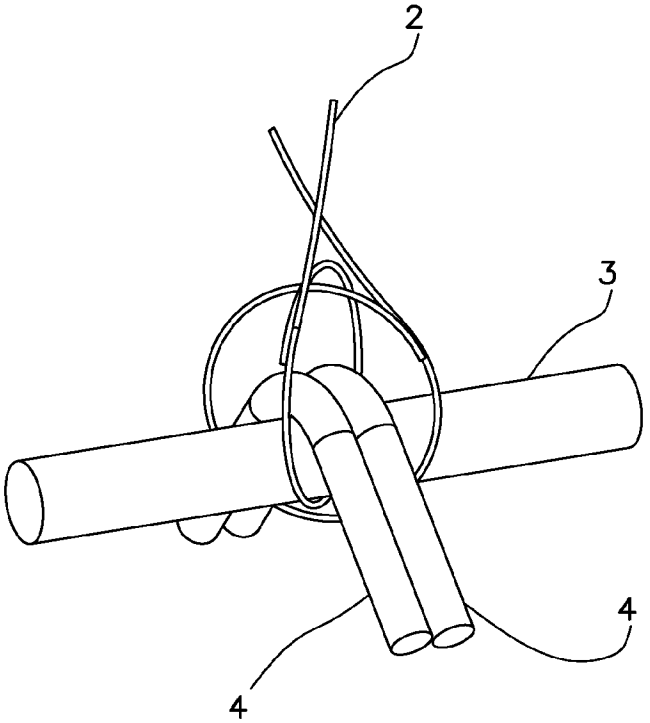

The illustrated embodiment, for example, provides four fingers 26, preferably angularly distributed around the binding axis A, for making a double binding, i.e. to allow the engagement of a pair of wires 2, to be wound and crossed around a first element 3 and preferably to at least a second element 4, which are superimposed or crossed (see in particular FIGS. 26 and 27).

Each finger 26 preferably provides at least one operating surface 27, for example lateral, preferably a pair of operating surfaces 27 preferably laterally opposite each other, with increased friction. For example, these operating surfaces 27 can provide at least partially a knurled area or a knurled coating, for example on at least part of a lateral face of the respective finger, or for example on both opposite lateral faces, to ensure a secure engagement of the wire 2, as described in detail below (see FIGS. 8 and 14).

In particular, the fingers 26 act as binding members for the wire 2 when the binding head 20 is rotated around the binding axis A. During this step, opposite portions of the wire 2 are forced to bend as a result of the rotation of the binding head 20, as they are "trapped" inside openings 20*a*, 20*b* defined in the binding head 20, arranged in said holding configuration, as described below (see FIG. 19*b*). This bending retains the same portions of wire 2 with a secure abutment of the fingers 26, preferably through the friction generated against the operating surfaces 27. The bending of respective portions, in particular the ends of the wire 2, blocks the wire 2, usefully allowing a limited, in particular controlled, friction sliding thereof, adequate to allow the formation of a twisted portion 101 of binding, compensating the progressive return of the wire 2. In particular, this friction sliding has the function of avoiding premature tearing of the twisted portion 101 of the wire 2, and instead of allowing the separation thereof only at the desired tensioning of the binding, such as to make it effective and robust.

Figure 19B:
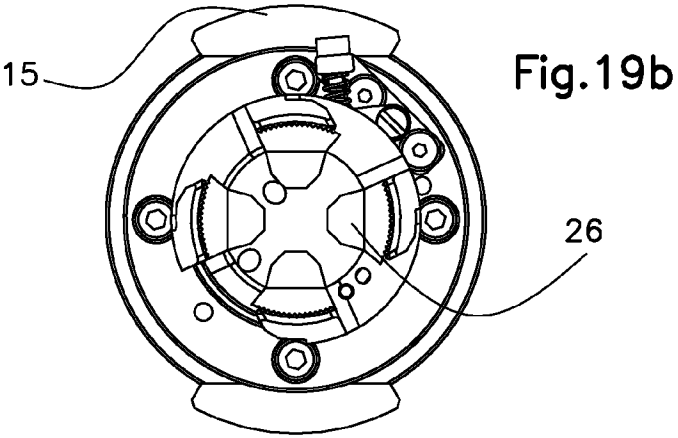

The fingers 26 are therefore angularly spaced so as to define between them at least a first passage 28*a* and a second passage 28*b*, suitable for the passage of a respective wire 2, respectively for an initial end and a final end of the winding of the same wire 2 (see FIG. 19*b*). The first passage 28*a* and the second p 28*b* are open on one side at least, in particular facing an operative space for calendering, thus defining a respective open profile. In other words, the first operating member 24 thus shapes at least the first passage 28*a* and the second passage 28*b* opposite and/or adjacent around the binding axis, suitable for the passage of a first branch 2*a* and a second branch 2*b* of the wire 2, adjacent to the first branch 2*a*, calendered in a ring around the first element 3 and/or the second element 4, by the calendering assembly 30, as described below (see FIG. 7).

The passages 28*a*, 28*b*, in particular, are suitable for the engagement of the wire 2, in particular on the operating surfaces 27, and open towards the opposite end with respect to the keying member 22, in use, for example, below, so as to enable the extraction of the apparatus 1, at the end of a binding cycle.

The second operating member 25 cooperates with the first operating member 24 to hold the wire 2 or the wires 2, essentially closing the open profile of the passages 28*a*, 28*b*. In practice, this cooperation makes these openings 28*a*, 28*b* at least partially inaccessible, therefore with a closed profile, to prevent the wire 2 from coming out, in particular in front of the binding head 20, according to an axial direction of the apparatus 1, as described in details below.

Figure 8:
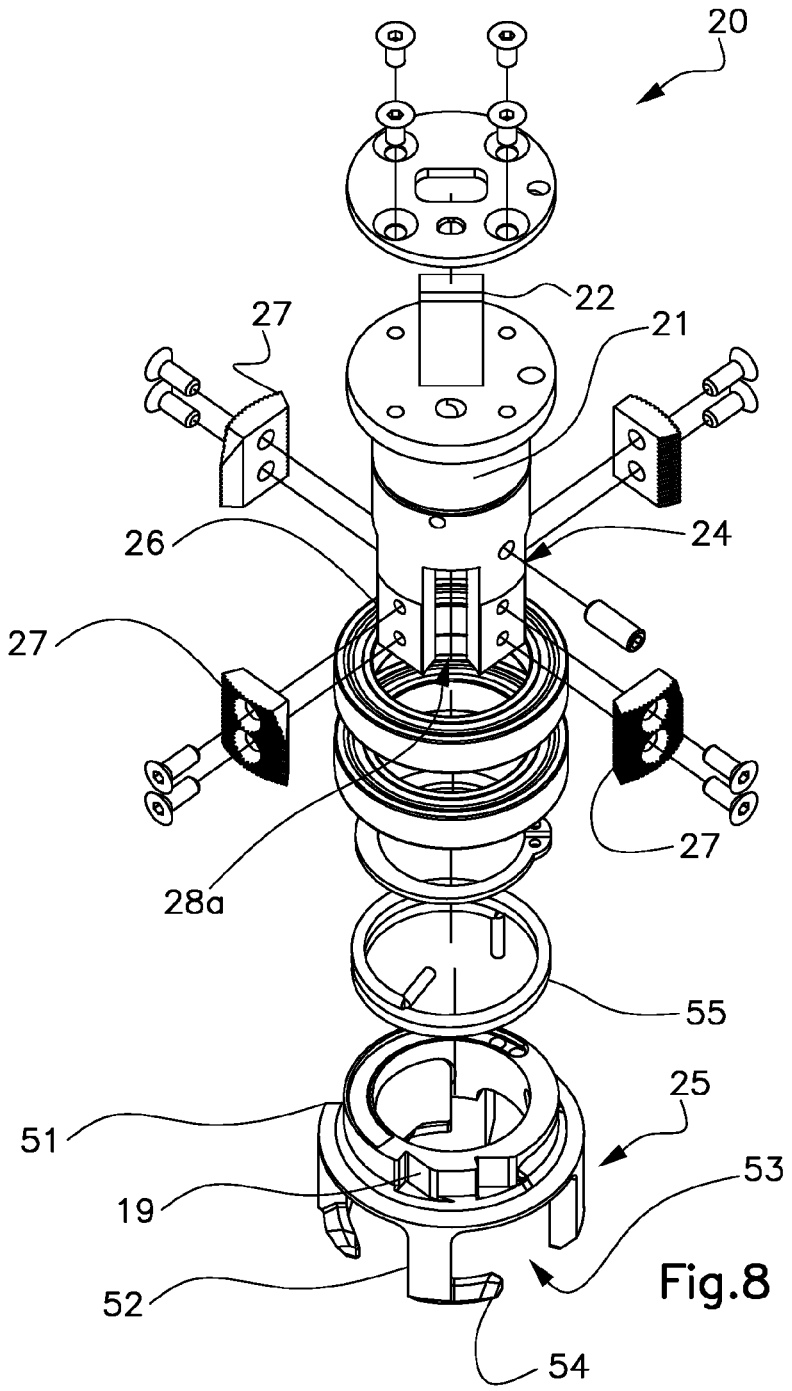
FIG. 8 is an exploded view of a detail used in the apparatus object of the invention.

More precisely, the second operating member 25 forms a ring 51 from which a plurality of separator elements 52 extend longitudinally, angularly spaced around the binding axis A and in a number at least corresponding to the number of fingers 26 (see for example FIG. 8).

The separator elements 52 define between them as many spaces 53*a*, 53*b*, as correspond to the passages 28*a*, 28*b*. The spaces 53*a*, 53*b*, like the passages 28*a*, 28*b*, are open in front of the binding head 20, therefore towards said calendering space, from the side opposite the connection portion 14, for example, in use, below if the binding is carried out by inserting the apparatus 1 on the overlapping or crossing area of the elements 3, 4 with a vertical downward movement (see for example FIGS. 8 and 19*b*).

The separator elements 52 can have a substantially longitudinal development and a holding portion 54, for example extending transversely, for example like a hook, so as to form a protruding edge, useful for closing the open profile, in particular in the calendering space in front of the binding head 20, according to an axial direction, of the passages 28*a*, 28*b* in said holding configuration, approaching the fingers 26, to hold the wire 2 inside them during the twisting step. On the other hand, when the binding head 20 is arranged in said open configuration, as described below, the same holding portion 54 is separated from the fingers 26, leaving free access to the passages 28*a*, 28*b* from the respective side, for example below, to allow, at the end of the binding, the expulsion of a binding residue which may have remained in the binding head 20, as described below.

The second operating member 25 is rotatably mounted around the first operating member 24, by means of the interposition of elastic contrast means 55, for example made up of a torsion spring. Elastic means 55 is arranged to keep the second operating member 25 in said holding configuration (see FIG. 8).

More precisely, the first operating member 24 and the second operating member 25 can be mutually movable according to a relative rotational motion around the binding axis A, to define at least a first opening 20*a* and a second opening 20*b* of variable width, between the open configuration (see FIG. 19*a*), in which said passages 28*a*, 28*b* and said spaces 53*a*, 53*b* are substantially facing each other and the holding portions 54 spaced away from the fingers 26, so that the first opening 20*a* and the second opening 20*b* have an open profile on the side facing the calendering space, to leave a passage for the wire 2, for example in the feeding step or in an unloading step, and the holding configuration (see FIG. 18*a*), in which said openings 28*a* have a closed profile following the reciprocal sliding between the same members, following which the holding portions 54 are approached to the fingers 26, in such a way as to engage the wire 2, holding their respective opposing portions, contiguous to said opposing branches 2', inside the binding head 20, to twist it around the binding axis A.

In particular, in said holding configuration, with the rotation of the binding head 20 the wire 2 is bent against the respective finger 26, thus remaining locked. During the step of twisting around the binding axis A, when the actuation member 13 rotates the first operating member 24 and the second operating member 25, the increased friction surfaces, if usefully provided, of the fingers 26, have the effect of holding the bound wire 2, limiting its sliding.

More precisely, the engagement action carried out on the wire 2 through the openings 20*a*, 20*b* with variable amplitude of the operating members 24, 25 is such that it blocks the wire 2 to ensure the tensioning of the binding, and at the same time allow the wire to slide 2 on the same operating surfaces, such as to ensure correct twisting of the wire 2 and at the same time avoid anticipated tearing or damage to the binding material.

Moving the fingers 26 near the separator elements 52, to close the profile of the openings 20*a*, 20*b*, is advantageously carried out thanks to the action of the elastic contrast means 55, which act to close the profile of the openings 20*a*, 20*b*, therefore in particular of the holding portions 54 moved near the fingers 26.

More precisely, in the holding configuration, the wire 2 is held inside the openings 20*a*, 20*b*. Advantageously, the holding portions 54 can be shaped, for example, in a curved way, to guide the wire 2 towards a bending against the fingers 26.

It should be remembered, as anticipated, that the ring 51 also has the plurality of recesses 19 or notches, angularly spaced, for coupling to the rearrangement means 18 described above.

By suitable rotation of the binding head 20, for example in a clockwise direction B, said rearrangement means 18 can position themselves beyond the closest recess 19 of the ring 51, which is rotatable around the binding axis A, against the contrast of the elastic means 55 mentioned above. In this circumstance, by rotating it in the opposite direction, the rearrangement mechanism 18 can couple said recess 19, so as to block the second operating member 25, making it integral with the body 10. A subsequent rotation of the binding head 20 then moves only the first operating member 24, thus allowing the compartments 28*a*, 28*b* to be aligned in a controlled manner with the spaces 53*a*, 53*b*, in the open configuration, and/or the conduit 16 with the channels 23 of the binding head 20, to start a new binding cycle.

At the same time, the described rearrangement cycle can advantageously allow the alignment or realignment of the cutting assembly 40 as well, as described in detail below.

The calendering assembly 30 serves to guide the wire 2 or, in case, each wire 2, through a substantially circular path winding around the first element 3 and/or preferably the second element 4 in the respective overlapping or crossing area. In practice, during the winding step, the end of the wire 2 passes through the openings 28*a*, 28*b* and the spaces 53*a*, 53*b* of the binding head 20, mutually facing and accessible, in the open configuration, to guarantee then, by moving the fingers 26 and to the separator elements 52, an effective engagement in the holding configuration, in the twisting or winding step.

The calendering assembly 30 shapes, for example, a sleeve 31 inserted axially around the binding head 20 and fixed by the attachment means 15 to the connection portion 14 of the body 10.

The sleeve 31 has a greater longitudinal extension with respect to the binding head 20, and therefore, in the assembled position, protrudes with respect thereto, in such a way that the operating space of calendering is defined for winding the wire 2 around the elements to be joined. In particular, this operative space for calendering is adjacent, in use, for example lower, with respect to an operative space for winding, in which the twisting by the binding head 20 is carried out.

The sleeve 31 has internally at least one calendering path for the wire 2. In particular, this path can be made by means of an input track 32 and a return track 33, opposed to the first, with respect to the binding axis A, so as to ensure, following the entry of the end of the wire 2 through the first opening 20*a* of the binding head 20, the complete winding of the wire 2 and the return of the respective end through the corresponding second opening 20*b* of the binding head 20, to ensure, as described, the subsequent twisting step.

The tracks 32, 33 are preferably advantageously curved, at least partially, to guide the winding of the wire 2, and preferably made by means of special grooves on the internal walls of the sleeve 31.

The winding paths, each made up of the input track 32 and of the return track 33, are preferably staggered, in particular along the longitudinal axis of the apparatus 1, therefore they have different heights, to avoid interference in the crossing of the wires 2, in case of double crossed binding, for example.

More precisely, the calendering path of the wires 2 and, in particular, the input tracks 32 and the return tracks 33 can be advantageously made by means of inserts, for example of steel, suitably applied inside the sleeve 31. The latter can instead be made of plastic and/or aluminum, in order to contribute to the lightness of the apparatus 1.

Furthermore, each input track 32 is preferably associated with a calendering roller 34, configured to counteract the natural resistance of the wire 2 to follow the calendering path. More precisely, the rollers 34 can be usefully supported cantilevered by the sleeve 31 or by the same tracks 32, to allow the disengagement of the wires 2 from the tracks 32 during twisting (see FIG. 7).

The return track 33 preferably forms an initial portion in the form of a guide, for example shaped like a funnel or at least partially conical, to facilitate the insertion of the wire 2, thrown from the input track 32. This throw derives from the fact that a gap is usefully provided between the input track 32 and the return track 33, to give space for receiving the elements 3, 4 to be joined, inside the calendering space.

The calendering assembly 30 is formed in a shaped manner, such as to present at the front at least one shaped cavity, for housing, in abutment, respective element to be bound. Thanks to this conformation, the apparatus 1, on which the calendering assembly 30 is carried at the front, can be moved, in abutment, with a simple movement along the longitudinal axis, near the element 3, 4 to be bound. In other words, said shaped conformation allows a secure, preferably adjustable, abutment against the element 3, 4.

Figure 32:
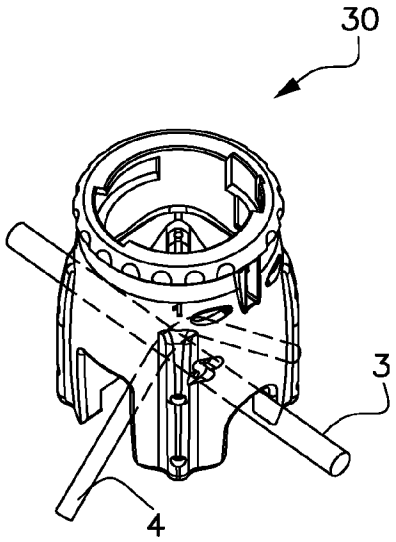
Figure 31:
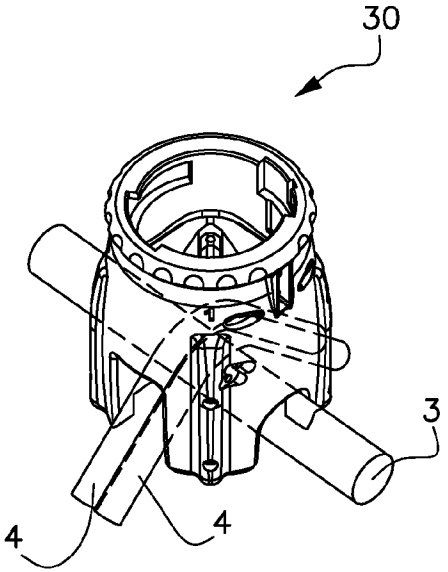
Figure 34:
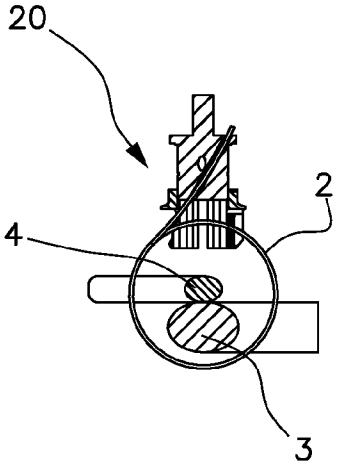
FIGS. 34, 35, 36, 37 are a sectional view of a detail of the apparatus according to the invention, in different operating steps of the binding process of a first element and a second element.
Figure 35:
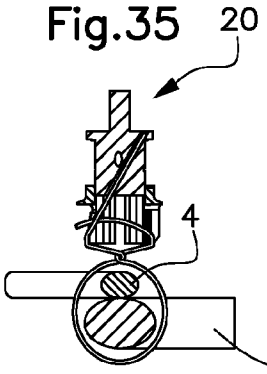
Figure 36:
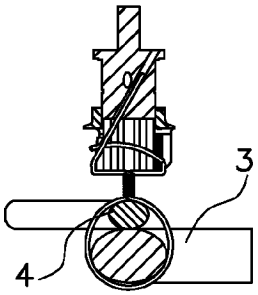

More precisely, the sleeve 31 can have at the free end shaped recesses 35, arranged at least in pairs, preferably crosswise, with respect to the binding axis A, so as to ensure the positioning of the calendering assembly 30 on the element to be bound or, in the case of a first element and a second element, on the overlapping area, at the intersection, precisely, between the first element 3 and the second element 4, and the correct winding of the wire 2 around them (see FIGS. 11*a*, 11*b*, 11*c*, in particular). In particular, the conformation of the shaped recesses 35 determines the distance between the elements 3, 4 and the binding head 20, when the apparatus 1 is positioned against at least one of the same elements 3,4. The shaped recesses 35 can have different depths, for example for the correct support on the furthest element from the binding head 20, for example in the case of binding a first element 3 and a second element 4 arranged at intersection (see FIGS. 31, 32, 33).

Figure 33:
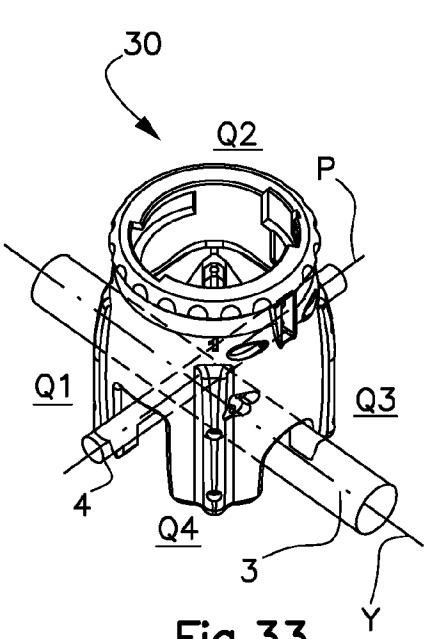
FIGS. 31, 32 and 33 are respectively a perspective view of the calendering assembly used in the apparatus according to the invention positioned on different types of elements to be bound.

FIG. 33 shows that whenever the first element 3 and the second element are arranged in a superimposed crossed configuration, they can define at an intersection area, on a plane containing the longitudinal axis Y of one of the first element 3 and the second element 4, in the case of element 3, and the projection P of the longitudinal axis of the other, four respective quadrants Q1, Q2, Q3, Q4.

Finally, the cutting assembly 40 comprises a fixed knife 41 and a movable knife 42 (see FIGS. 9*c* and 15).

Advantageously, the fixed knife 41 is integral with the body 10, in particular with the connection portion 14, while the movable knife 42 is integral with the binding head 20, in particular with the support member 21.

More precisely, the knifes 41, 42 can be made up of respective members, for example plates, one fixed and one movable, respectively mounted on the connection portion 14 and on the support member 21 and having respective holes 43, 44, of insertion of the wire 2, arranged, in use, along the path of feeding of the wire from the body 10 to the binding head 20. In practice, the cutting of the wire 2 can be caused by a further relative rotational motion, between the body 10 and the binding head 20, bearing said holes for the passage of the wire, which is thus cut.

Advantageously, if the apparatus 1 is designed to feed a pair of wires 2, it is possible to provide that one of the two said holes, for example the hole on the movable knife 42, is made up of a slot 44*a*, such that the sequential cutting of the wires 2 is performed, thus temporally distributing the cutting effort and avoiding overloads.

It should also be noted that the rearrangement cycle described above, implemented thanks to the rearrangement mechanism 18, can also allow, as anticipated, the realignment of the holes 43, 44, after the cutting step, in order to start a new feeding step and therefore the insertion of the wires 2.

The operation of the apparatus according to the invention, which implements the method according to the invention, is understandable from the above description.

The operation for a double binding, in particular the crossed one, is described below, meaning that it is also possible to provide for a binding with a different number of wires 2, for example to perform a simple binding.

At an early preparation stage, a rearrangement cycle is commanded to ensure that the openings 20*a*, 20*b* of variable width of the binding head 20 are, for example, in the open configuration, therefore accessible for the wire 2 and that the knives, fixed and movable, 41, 42 of the cutting assembly 40 are correctly aligned, to allow the passage of each wire 2 through the conduit 16 and, in succession, the channel 23 of the binding head 20.

Basically, the operator can control, through the control member 12, a first rotation of the binding head 20 around the binding axis A, for example in a clockwise direction B, so that the rearrangement mechanism 18 passes the recess 19 closest to the ring 51 of the second operating member 25 (see FIGS. 17*a*, 17*b*, 17*c*).

Figure 18B:
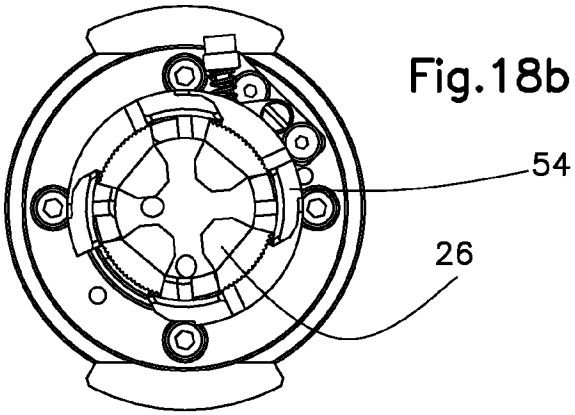
FIGS. 18*a*, 18*b*, 18*c* and 19*a*, 19*b*, 19*c* are respectively the same views of FIGS. 17*a*, 17*b*, 17*c* in different operating configurations.
Figure 18C:
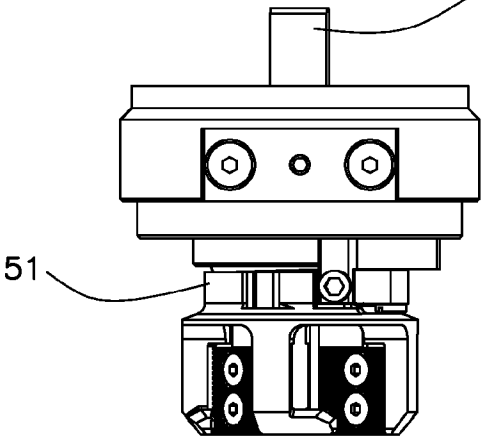
Figure 18A:
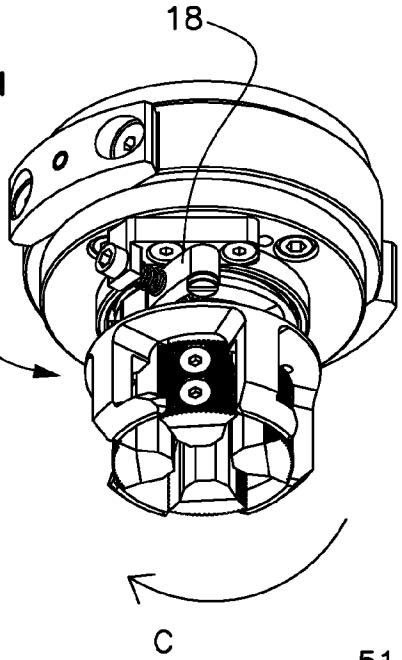

Subsequently, the operator can command a second rotation, in the opposite direction, for example in the anticlockwise direction C, so that the rearrangement mechanism 18 engages said recess 19, thus blocking the second operating member 25 (see FIGS. 18*a* to 18*c*).

Figure 19C:
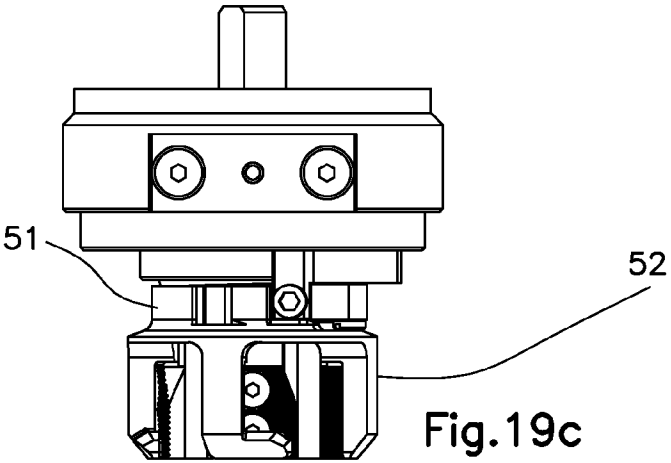
Figure 19A:
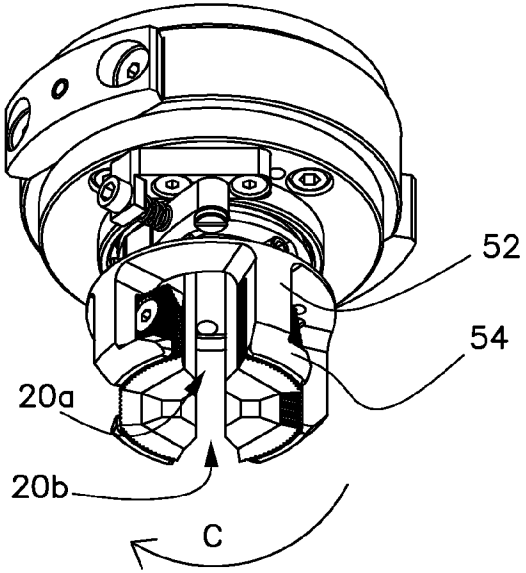
Figure 23:
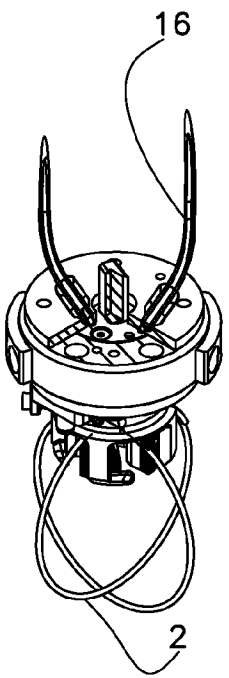
FIGS. 20 to 23 are respectively a perspective view of a portion of the apparatus, and partially sectioned views, in following operating steps for the shearing of a metal binding material.
Figure 22:
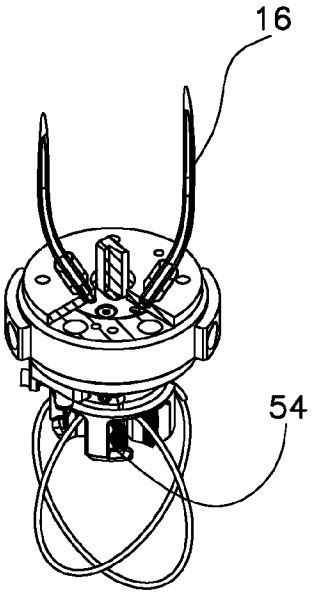
Figure 21:
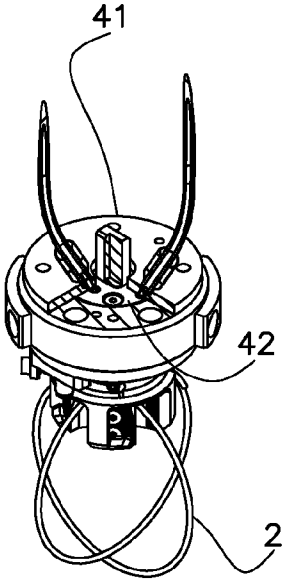
Figure 20:
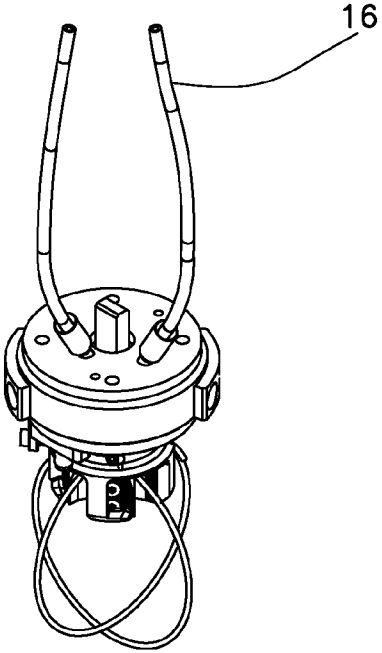
Figure 25B:
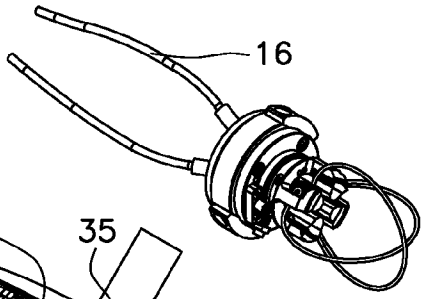
FIGS. 25*a* and 25*b* are respectively the same views of FIGS. 24*a* and 24*b*, in an operational open configuration of the binding head.
Figure 25A:
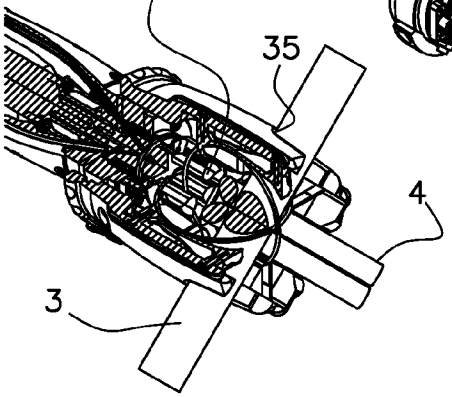
Figure 24B:
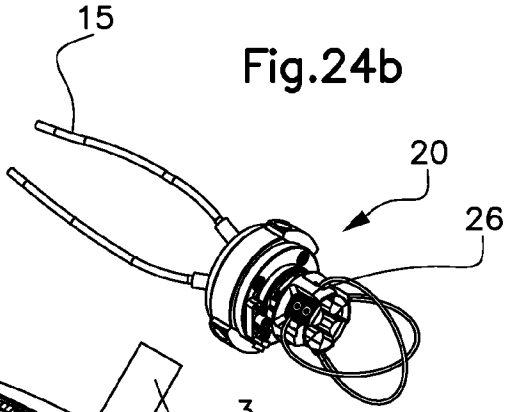
FIGS. 24*a* and 24*b* respectively show a partially sectioned perspective view of a detail of the apparatus according to the invention with and without the calendering assembly and the elements to be bound, in an operational configuration for closing the binding head.
Figure 24A:
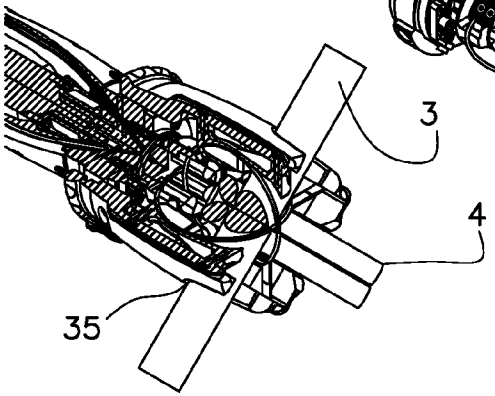

By continuing the rotation of the binding head 20, a relative angular displacement is then produced between the first operating member 24 and the second operating member 25, which arranges the binding head 20 in an open configuration, with the openings 20*a*, 20*b* having an open profile for the passage of opposite portions of the wire 2 (see FIGS. 19*a* to 19*c*).

The described rearrangement procedure, carried out by means of successive and controlled rotations of the binding head 20, can be carried out automatically by activating, preferably with a single gesture by the operator, the control member 12.

At this point, the operator can position the apparatus 1 at the overlapping portions of the first element 3 and the second element 4 to be bound.

The drawing assembly 7 is then activated, preferably by means of autonomous drives for each wire 2, for unwinding the reels 5 and feeding the wires 2 inside the body 10. This allows the same apparatus 1 to carry out double or single bindings, switching from one mode to the other quickly.

In particular, each wire 2 follows the feeding path through the conduits 16 in the body 10, the holes 43, 44, 44*a* of the cutting assembly 40 and, finally, the channels 23 of the binding head 20.

In particular, the curved conformation of the terminal portion 16*a* of each conduit 16 "erases the memory" of all the distortions suffered in the path up to that point followed by the wire 2, from the reel 5 inside the apparatus 1 (see in particular FIG. 7).

The end of the wire 2 then emerges from the channel 23, oriented in such a way as to go beyond the first opening 20*a*, in said open configuration, resulting from the controlled superimposition of the first passage 28*a* and the first space 53*a*, and thus reaching the operating space of calendering of the calendering assembly 30.

The end of the wire 2 is then calendered against the roller 34, through the input track 32 and the output track 33, so as to wind the first element 3 and the second element 4. In particular, in the illustrated case, the input tracks 32 and the output tracks 33 are arranged in such a way as to wrap the wires 2 in a criss-cross manner around the elements 3, 4 to be bound (see for example FIGS. 26 and 27).

At the end of the feeding step, the end of each wire 2 returns to the binding head 20, thus being guided through the second opening 28*b* (see in particular FIG. 7).

Then, each wire 2 is cut by the cutting assembly 40. To do this, the rotation of the binding head 20, for example clockwise B, is then commanded. At first the rotational motion causes the sliding of the movable knife 42 on the fixed knife 41, thus producing the sequential blanking of the wires 2 (see FIGS. 20 to 23).

The rotation of the binding head 20 also causes the release of the rearrangement means 18 and the relative angular sliding between the first operating member 24 and the second operating member 25, such as to position them in the holding configuration. In this configuration, each wire 2 is then held inside the first opening 20*a* and the second opening 20*b* of the binding head 20. In particular, said opposite portions of wire 2 pass from the inside of the binding head 20 through the same openings 20*a*, 20*b*, but cannot come out from them because the relative profile is closed by moving the holding portions 54 of the second operating member 25 close to the fingers 26 of the first operating member 24.

It is to be noted that the relative rotational motion of the first operating member 24 and of the second operating member 25 of the binding head 20 can be operated in appropriate time relationship with respect to the feeding of the wire 2, for example before starting the feeding of the wire 2, since it is also possible to provide that the closure of the profile of the openings 20*a*, 20*b* in the holding configuration allows the passage of the wire 2 transversely to the binding axis A.

After cutting, the retraction of the remaining wire 2 towards the respective reel 5 is preferably operated by the drawing assembly 7. This retraction prevents the remaining wire 2, connected to the reel 5, remaining inside the terminal portion 16*a* of the conduit 16, in particular inside the respective sheath, from engaging the cutting assembly 40, thus risking, following actuation of the binding head 20, to be sheared at each rotation and to jam the operation of the binding head 20 with the products of the shearing off. The non-return device 60 can prevent during the retraction or return step that the wire 2 is rewound in a disorderly manner on the reel 5, creating, thanks to the guide means 61 arranged in the return configuration 61*b*, appropriate loops or deviations outside the reel 5.

The further rotation of the binding head 20 then drags the ends of the wires 2, held by the binding head 20, in a step of twisting around the binding axis A. In particular, since in the holding configuration of the binding head 20 the openings 20*a*, 20*b* have a closed profile, the rotation around the binding axis A causes the bending of the opposite portions of the wire 2 emerging from the openings 20*a*, 20*b*, substantially in contact with the fingers 26. Thanks to the aid of the guide tracks 32, 33 and to the holding action of the bending of the opposite portions of wire 2, preferably strengthened by the operating surfaces 27 with increased friction, each wound wire 2 is brought to progressively approach the first element 3 and the second element 4, tightening them correspondingly (see FIGS. 34 to 37).

Figure 38:
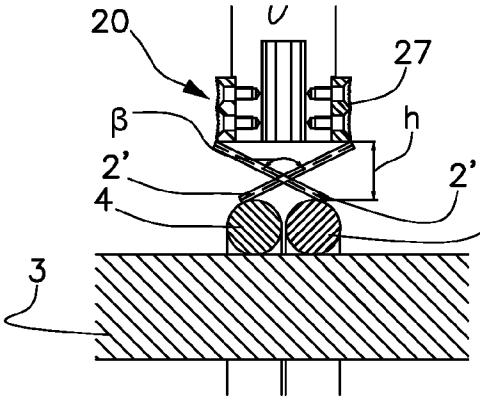
FIG. 38 shows an enlarged sectional view of a detail of the same apparatus, in an operative step of the binding process of a first element, of a further transversal element moved close to the first element and of a second longitudinal element.

In particular, in an initial twisting step, when the wire 2 is tightened around the first element 3 and possibly the second element 4, if provided, the opposite branches 2' of the wire 2 are arranged crossed between the elements to be bound and the binding head 20 (see FIG. 38). These opposite branches 2', tangent to the elements 3, 4 to be bound, closest to the binding head 20, are incident and form a binding angle β between them which is a function of the size of the elements 3, 4 to be bound, in particular of the transversal or longitudinal elements, curved or rectilinear, which are placed next to the binding head 20, and at least, preferably, of the distance h between the binding head 20 and the elements (see FIG. 38).

In practice, this distance h is adjustable through the conformation of the shaped recesses 35 of the calendering assembly 30, which determine the support of the apparatus 1 against the elements to be bound. This adjustment can be made for example by means of an adjustable stop, by arranging suitable spacers at the shaped recesses 35 and/or by replacing the calendering assembly 30.

The binding angle β is adjusted in such a way as to be suitable for achieving the correct tensioning of the wire 2 during the twisting step around the binding axis A: not too large, otherwise the binding is excessively tensioned, risking breaking early, but also not too small, in which case it would determine an excessively high distance h, and therefore an equally extended twisted portion 101, which for example could protrude from the concrete cover.

The actuation member 13 stops when the control unit 9 detects that it is spinning idle or after a set number of revolutions. In particular, the twisting step can end when the twisted portion 101 in the shape of a wire braid 2 breaks, leaving a residual portion 102 to be expelled in the binding head 20. The twisted portion 101 is instead correctly tensioned and suitable for being covered by the concrete cover, without protruding therefrom.

For example, in the case of a double binding 100, for example, seven or eight rounds of binding are required, for the binding to be tight and form the twisted portion or braid 101, regular and compact. The number of revolutions is in any case a function, with the same transversal dimensions of the elements 3, 4, of the distance between the elements 3, 4 and the binding head 20, when the apparatus 1 is positioned in abutment, as well as of the transversal dimensions or diameter of the wire 2.

The rotation of the binding head 20 therefore causes the detachment of the twisted portion or braid 101 from the residual portion 102 of the wire 2, which remains gripped by the binding head 20.

Figure 37:
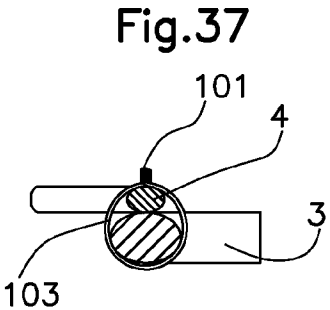

The obtained binding 100, simple or double, is in particular formed by a wound portion 103 and by the twisted portion 101 (see in particular FIG. 37).

The optimal position of the separation of the twisted portion from the residual portion 102 corresponds to the optimal height of the twisted portion 101 of the binding 100, simple or double. In practice, said optimal height of the twisted portion 101, once separated from the residual portion 102, is such as not to protrude, in use, from the concrete cover, which is generally no greater than about 20 mm. At the same time, the optimal height corresponds to a twisted portion 101 such as to ensure an effective seal, therefore robustness, of the binding.

The detachment of the residual portion 102 can be advantageously obtained, according to the method, by spontaneous shearing, by twisting, continuing with the twisting action of the wires 2. In this case the use, for this purpose, of an additional cutting assembly is avoided.

In fact, it has been found, from experimental tests, that with a binding angle β between 70°-135°, preferably between 90° and 110°, the breaking of the twisted wires 2 occurs spontaneously and statistically at the optimal height of the twisted portion 101. In order to obtain this optimal result and therefore to respect the experimental angles identified for the different transversal dimensions of the elements 3, 4 to be bound, it is possible to act on said distance h (see FIG. 38), suitably adjusting the abutment of the shaped recesses 35 made in front of the calendering assembly 30 with the closest or farther element or elements 3, 4 to be joined. Basically, spontaneous shearing at an optimal distance h allows to obtain an optimal height of the twisted portion, avoiding the provision of a special cutting assembly and, therefore, reducing costs and weight of the apparatus 1.

At the end of the binding step, as previously mentioned, a new rearrangement cycle is performed, operated by the rearrangement mechanism 18, to allow the binding head 20 to return to the open configuration, thus releasing the residual portion 102, which is discarded, of the wire 2.

The rearrangement can arrange the knives 41, 42 re-aligned and ready for a new binding cycle.

In particular, in this final step of the cycle, which can be operated by acting on the control element 12, various preparation operations can be carried out for a subsequent binding cycle.

For example, it is possible to command the drive of the drawing assembly 7, to push the respective wire 2 inside the respective channel 23, so as to eject the residual portion 102 and to clean the channel 23 from any waste.

Then, it is possible to make, preferably automatically, a retraction of the same wire 2, preferably beyond the terminal portion 16*a* of the conduit 16, to prepare it to "cancel", in a following feeding phase, the memory of any distortion present in the wire 2 or produced by the positioning of the apparatus and/or of the connection means 9 connected to it.

According to a further embodiment of the invention, illustrated in FIGS. 41 to 45, it is possible to provide that the cutting assembly 400 is made in such a way as to reduce the residual portion 102 and facilitate its expulsion from the binding head 200. This provision is intended to be combined, where possible, with the technical features of the embodiment described above.

In this case the actuation unit 13 is capable to operate both a rotational motion, as described above, and an axial motion, in particular an axial sliding motion. For example, the same driving member can generate the rotational motion and the axial motion therefrom by means of a screw and cam mechanism of a known type, not shown in the figure for simplicity.

The binding head 200 comprises, in addition to the first operating member 240 and the second operating member 250 substantially similar from a functional point of view to those described above, a third operating member 260 with the function of a movable knife 442, interposed axially sliding between the first operating member 240, more internal, having the function of a fixed knife, and the second operating member 250, more external.

Compared to the previous embodiment, the cut is therefore carried out thanks to the relative sliding between the third operating member 260 and the first operating member 240. In particular, the third operating member 260 shapes slots 442, preferably with longitudinal development, having the function of a movable knife 442, so as to shear the wire 2 exiting through the channels 23, as described above, from the first operating member 240. The cut therefore takes place on the external surface, preferably cylindrical, of the first operating member 240, rather than by rotation, on a plane transversal to the binding axis A, as described above.

Figures 41, 42A, 42B, 42C, 43A, 43B, 44, 45:
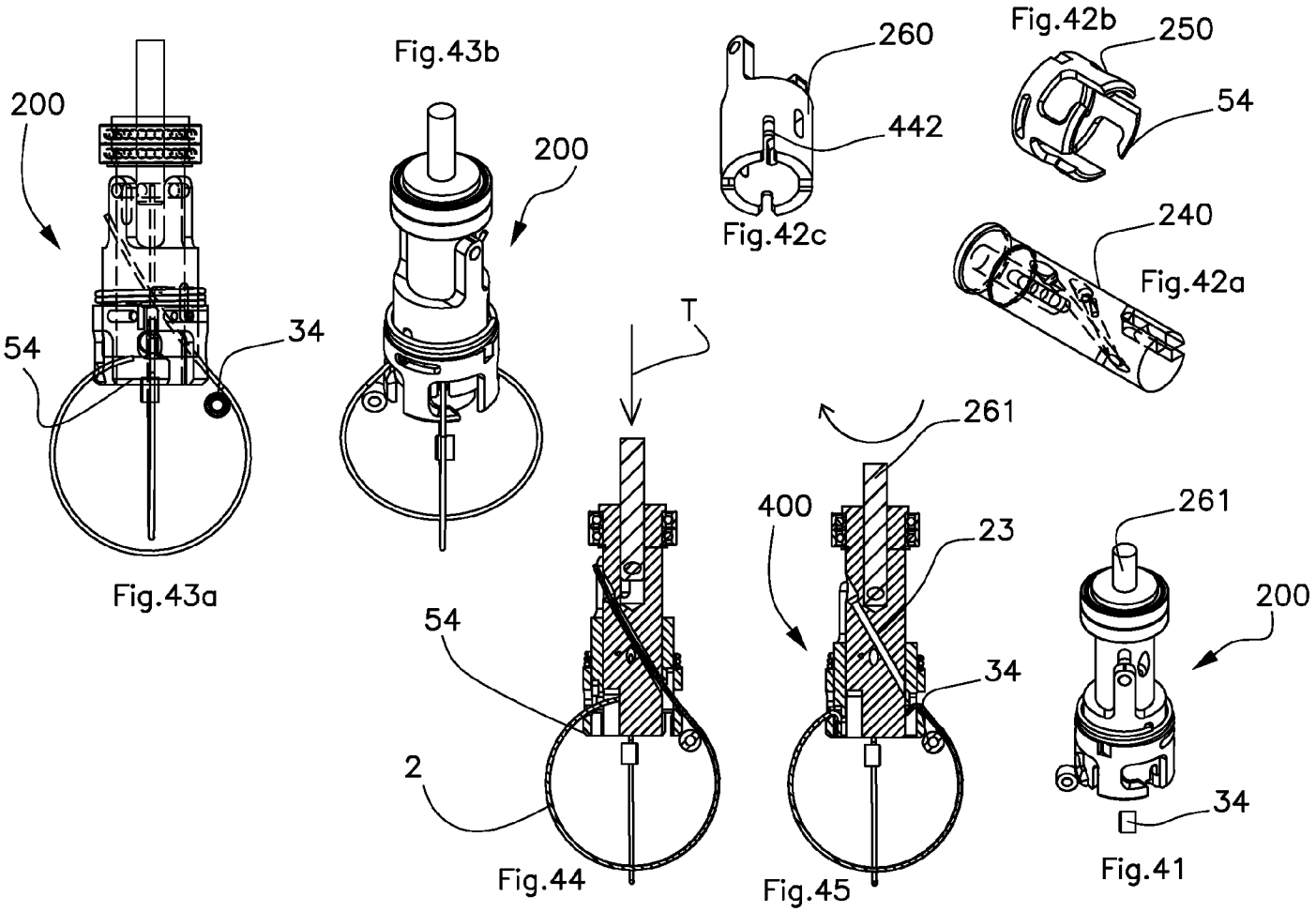
FIG. 41 is a perspective view of a second embodiment of the apparatus according to the invention.
FIGS. 42*a*, 42*b*, 42*c* are respectively perspective views of components of the apparatus illustrated in FIG. 41.
FIGS. 43*a* and 43*b* are respectively a front and perspective view of the apparatus illustrated in FIG. 41, in an operational step of feeding the wire.
FIGS. 44 and 45 are respectively a side view in section according to a median longitudinal plane of the apparatus illustrated in FIG. 41, in subsequent cutting steps.

The third operating member 260 is carried integral with the axial shaft 261, which is for example articulated to the third operating member 260 (see FIG. 42*c*).

The third operating member 260 is axially movable in a working stroke between a first inactive, retracted position, a cutting position, advanced along an axial cutting direction T, towards the first operating member 240 (see FIG. 44), and a further advanced bending position (see FIG. 45) in the same direction. In fact, beyond the cutting position, the extension of said stroke produces the bending of the sheared ends of the wire 2 against the holding portions 54 of the second operating member 250 (see FIG. 45).

The operation of the apparatus according to this embodiment is entirely similar to what was described above.

In particular, when the shaft 261 is in the inactive position, the wire 2 can be fed to the binding head 200. During this step, each wire 2 is wound and calendered around at least one of the elements 3, 4.

The actuation member 13 is then operated to produce the working stroke of the third operating member 260, for example by means of the aforementioned screw and cam mechanism. This stroke can be towards the calendering operating space, therefore for example in the downward direction, as in the illustrated case, or in the opposite upward direction to cooperate, for example, in the subsequent return to the inactive position, in the expulsion operation of any residual portions of binding.

The stroke of the shaft 261 determines, through the cutting and then bending position, the shearing of the wire 2 against the first operating member 240 and the bending of the sheared ends, which are thus engaged and retained.

Preferably, the remaining wire 2 is pulled back to free the channels 23 of the binding head 200.

At this point, the drive member 13 rotates the binding head 200, thanks for example to said screw and cam mechanism, continuing with the desired binding, as described above.

The further steps are almost identical to what was previously described, in particular, the expulsion of the residual portion 102 of the binding 100.

Figure 47:
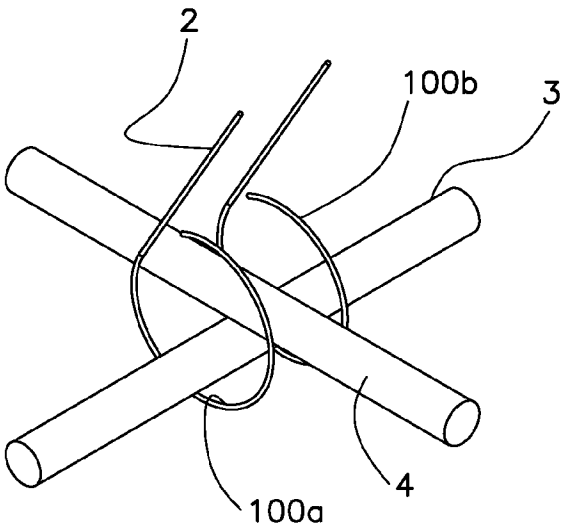
FIGS. 46, 47 and 48 are respectively a perspective view of a component of the apparatus according to the invention, in a different embodiment and of a binding obtained in a corresponding way, in an intermediate step and in a final step of operation.
Figure 46:
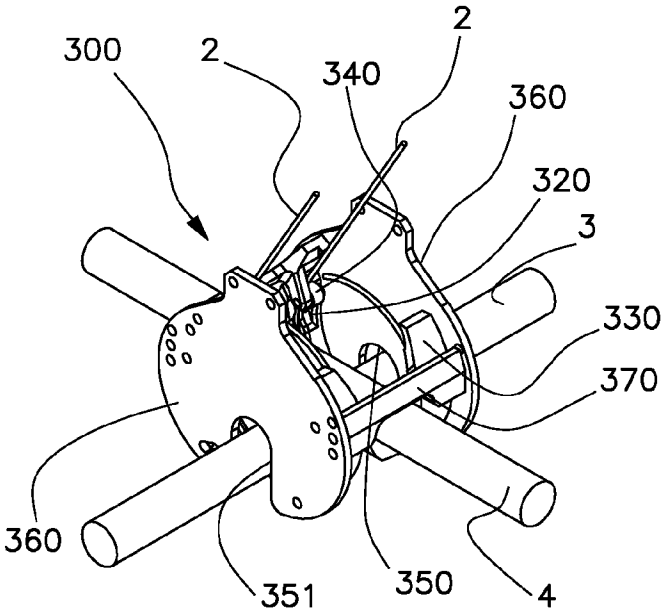
Figure 48:
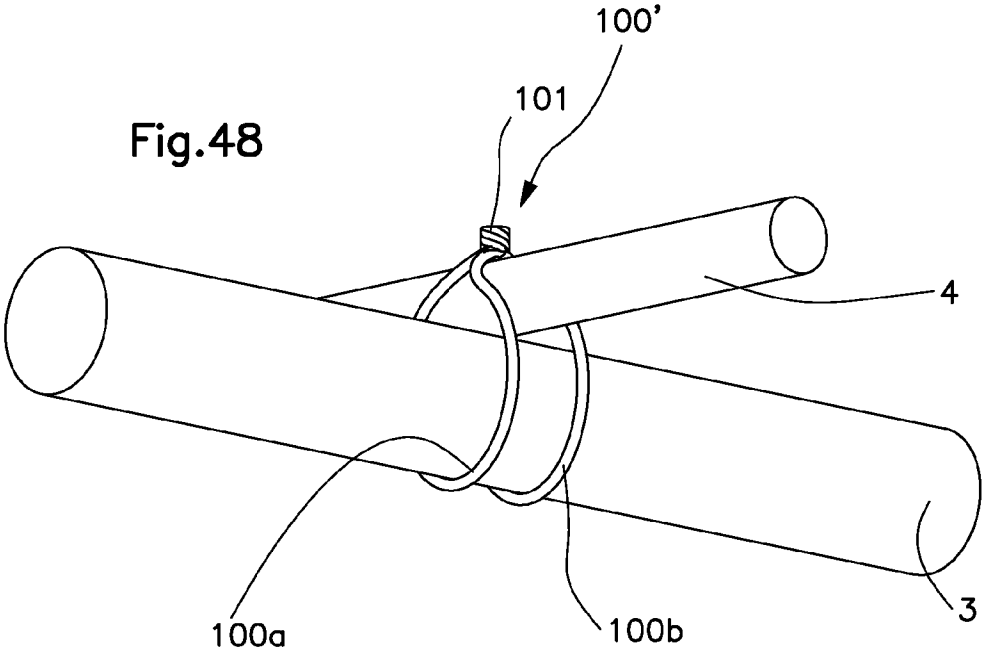
Figure 50:
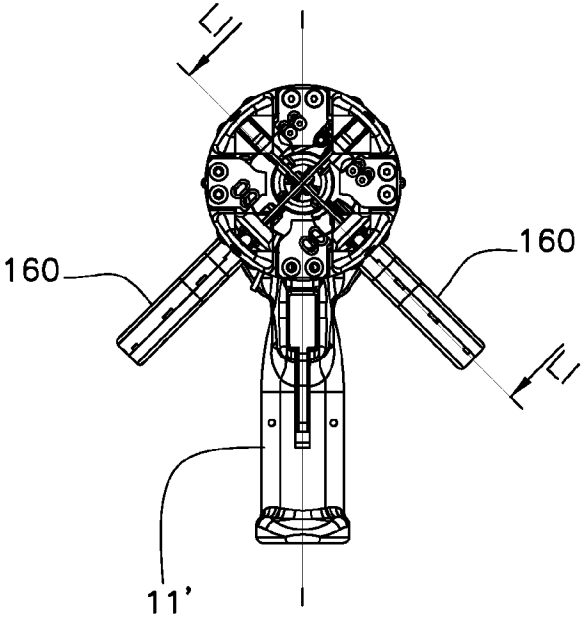
FIGS. 49 and 50 are respectively a perspective and side view of a further embodiment of the apparatus according to the invention.

According to a further embodiment of the invention, illustrated in FIGS. 46, 47 and 48, it is possible to provide that the apparatus 1 comprises a calendering assembly 300 shaped to create a double parallel binding 100'. More precisely, this binding comprises a wound portion 100*a* of the wire 2 and a wound portion 100*b* of a further wire 2, wound in such a way as to be substantially parallel and separated by the overlapping area of the elements 3, 4, around the element, between the first element 3 and the second element 4, further away from the binding head 20, and a single twisted portion 101, as described above, made by the twisting of four opposite branches 2', respectively of the wire 2 and of the further wire 2 around the same binding axis A. FIG. 47, in particular, represents an intermediate step of making the binding, wherein the twisted portion 101 is not yet visible, while FIG. 48 illustrates a final step wherein the binding 100' is completed.

In this case the calendering assembly 300 comprises a pair of forks 360, each forming the input track 320 and the return track 330, arranged substantially parallel, to wind the wire 2 and the further wire 2 around the element, between the elements 3, 4, farther therefrom. Forks 360 are connected by crosspieces 370. The crosspieces 370 and the forks 360 include respective shaped recesses 350, 351, for housing and, in case, abutting of the farthest element in its superimposed configuration.

The input tracks 320, as described for the other embodiments, are preferably associated with at least one contrast roller 340.

This variant is otherwise similar, also in operation, to what was previously described.

Figure 49:
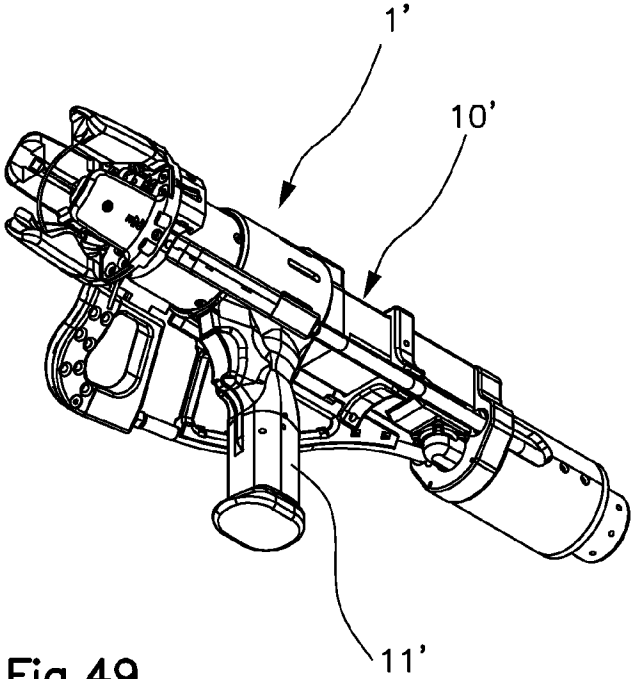
Figure 52:
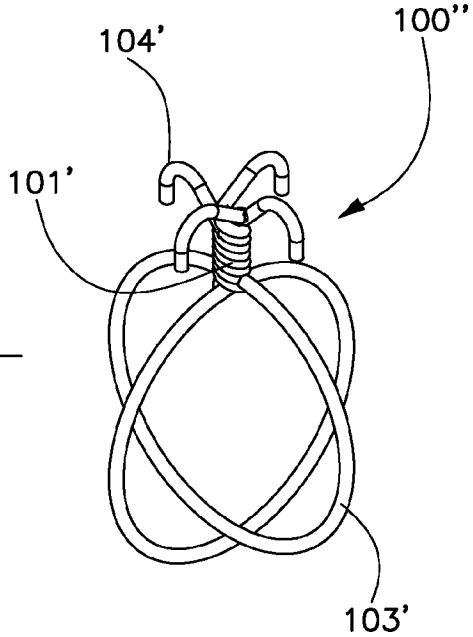
FIG. 52 is a binding made with the apparatus illustrated in FIGS. 49-51.

According to a further embodiment illustrated in FIGS. 49 to 71, the apparatus 1' preferably comprises the body 10' which extends along the binding axis A' and a handle 11' projecting transversely from the body, in particular perpendicularly, with respect to the binding axis A' (see FIG. 49).

The body 10' can further comprise a pair of wire guide shell 160, angularly spaced, for example by about 90°, around the binding axis A'.

Figure 51:
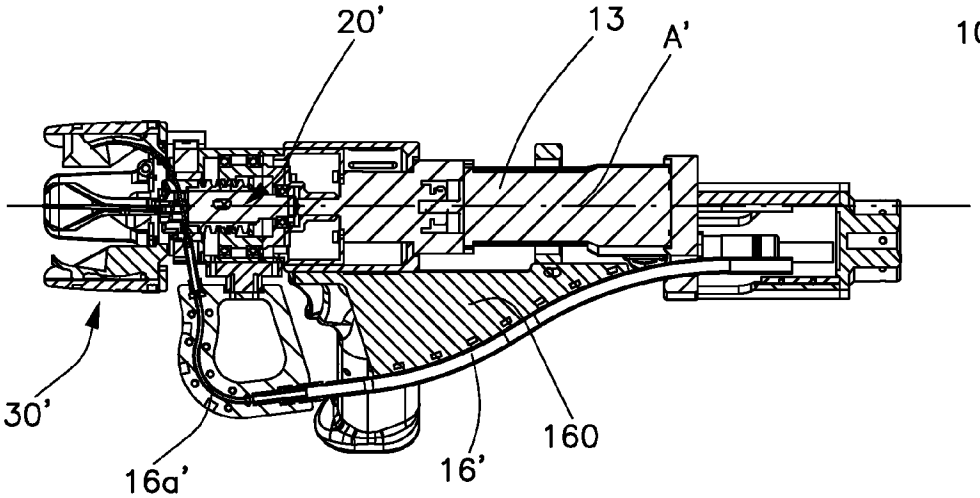
FIG. 51 is a sectional view along the plane LI-LI indicated in FIG. 50.
Figure 53:
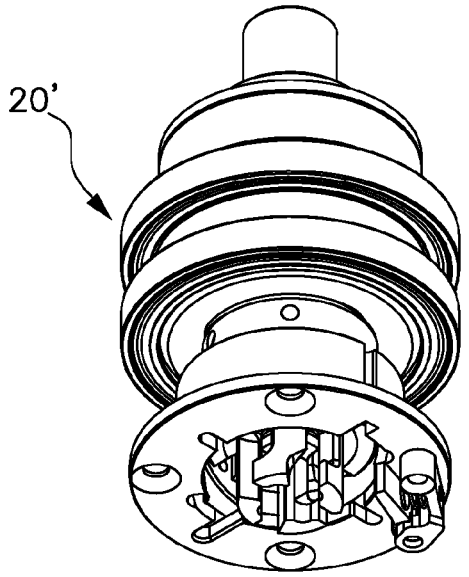
FIGS. 53, 54 and 55 are respectively a perspective view, in section according to an axial plane, and exploded view of a binding head used in the apparatus illustrated in FIGS. 49-51.
Figure 54:
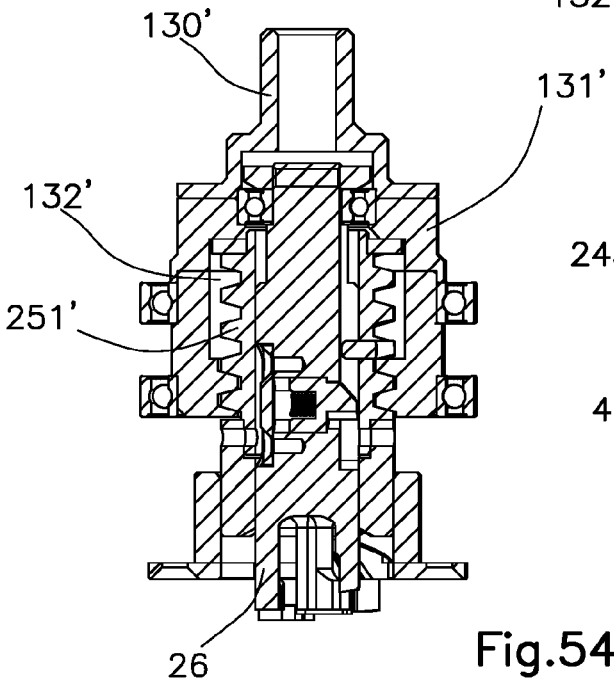
Figure 55:
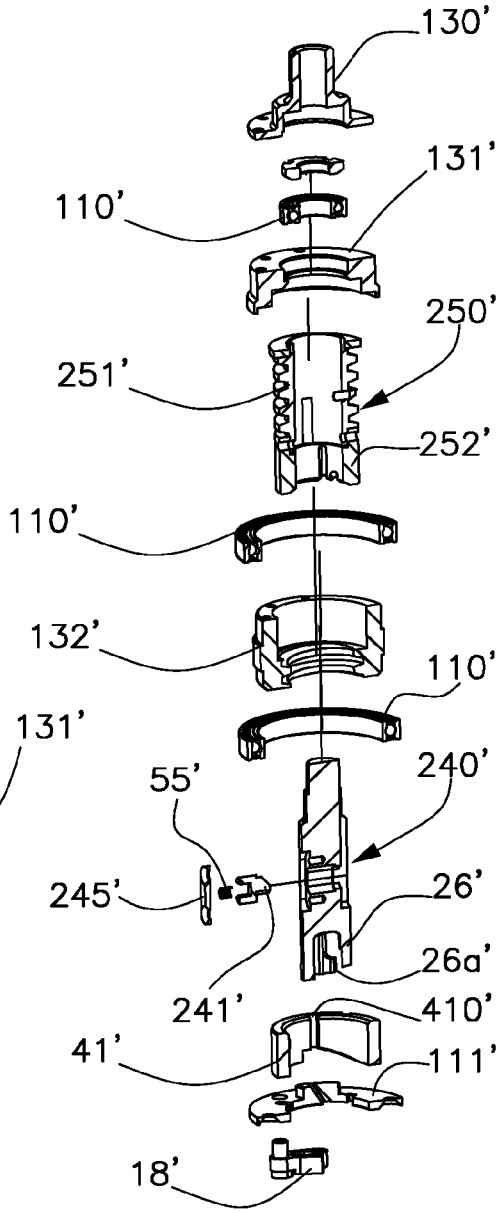
Figure 56:
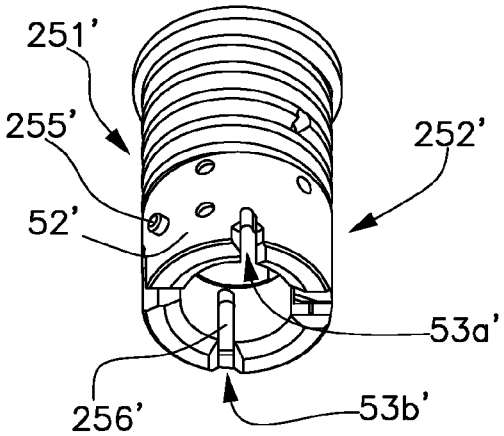
FIGS. 56 and 57 show a perspective and sectional view along an axial plane of a detail of the binding head illustrated in FIG. 53.
Figure 57:
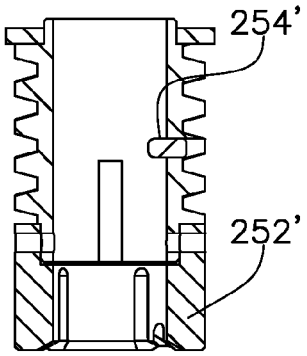

Each shell 160 can internally comprise the respective conduit 16' which, in turn, can comprise the rigid portion 16*a'* with a substantially curved development, so as to correspondingly deviate the wire 2 from a direction of insertion into the body 10', substantially parallel to the binding axis A', to a direction transversal to the same axis, for example close to the perpendicularity with respect to it, preferably with an axial component facing the front end of the apparatus 1' (see FIG. 51). This enables the insertion of the wire 2 in the respective first opening 20*a'* from the outside of the binding head 20' towards the inside, instead of from the inside thereof, so as to contain the overall size of the winding of the wire 2. The calendering assembly 30', in particular, is preferably mounted at the end of the apparatus towards which the wire 2 is introduced.

As in the embodiments already described, the apparatus 1' further comprises the binding head 20' inserted coaxially, preferably inside the calendering assembly 30'.

The binding head 20' cuts, tightens, twists the wire 2 around the binding axis A' and releases the binding 100" carried out.

The binding head 20' performs these operations preferably by activating only the motor member 13.

The motor member 13, in particular, operates an attachment member 130' at the output which in turn is mounted integral with a transmission element 132', for example by interposing a connecting component 131'. Preferably the transmission element 132' is made up of a ring equipped with an internal thread 133', intended to be coupled to a respective threaded element, for transmitting motion, as described below. The transmission element 132' is preferably supported by the body 11' by rolling support members 110'.

The binding head 20' includes the first operating member 240' and the second operating member 250', the first being inserted axially inside the second.

More precisely, the second operating member 250' is a tubular body forming a transmission portion 251', for example at the end, and a cutting portion 252' at the opposite end. The transmission portion 251' is intended to be coupled to the transmission element 132' to receive therefrom the motion driven by the motor member 13.

The transmission portion 251' is preferably made by means of a thread intended to be rotatably coupled to the transmission element 132', in particular at the internal thread 133 'of the transmission element 132', thus transmitting the corresponding rotational motion together with an axial translation component.

The cutting portion 252' has in particular at least a first space 53*a*' and a second space 53*b*'. In particular, the first space 53*a*' can be made up of a first slit and the second space 53*b*' of a second slit, which extend longitudinally, therefore parallel to the binding axis A', to interact respectively with a portion of the wire 2 intended to be sheared and subsequently tightened, in particular clamped, and with an opposite end portion of the same wire 2 intended to be tightened, in particular clamped, by the same cutting portion 252' (see FIG. 56).

The first space 53*a*' and the second space 53*b*' refer for this embodiment to the longitudinal slits which serve as open passages for the wire 2 through the preferably cylindrical wall of the cutting portion 252'.

Preferably, from the inner side of said wall, these slits continue with respective grooves, preferably of correspondingly differentiated extension for the first space 53*a*' and for the second space 53*b*' respectively, so as to preferably end at the same longitudinal height. The grooves 256' serve to usefully house the ends of the wire 2, tightened and bent between the outer wall of the first operating member 240' and the inner wall of the cutting portion 252' of the second operating member 250'. In essence, these grooves 256 'can act as a guide for such bending, as described in detail below.

In particular, the first space 53*a*' and the second space 53*b*' have different longitudinal extension, to interact in a different way on the respective end or portion of the wire 2. In particular, the first space 53*a*' has a greater extension and is at least partially delimited by a cutting edge, preferably at the top of the slit, to act as a movable knife, for the wire 2, as described in detail below, while the second space 53*b*' has a shorter longitudinal extension, in order to interact with one end of the wire 2, tightening it, in a step prior to cutting, in the context of the cutting motion carried out by the second operating member 250', as described below.

The first space 53*a*' and the second space 53*b*' are separated from each other by respective separator elements 52' (see FIG. 56) which shape the annular part of the cutting portion 252'.

The second operating member 250' internally comprises a first guiding element 254', for example made up of a transverse pin, to guide the motion of the first operating member 240'.

The second operating member 250' externally comprises a second guide element 255', for example made up of a radial pin, capable of being received in a respective longitudinal slit 410' made in a fixed component of the apparatus 1', for example on the fixed knife 41' of the cutting assembly 40', to guide the motion of the second operating member 250'. More precisely, the coupling of the second guide element 255' inside said slit 410', allows the transformation of the rotational motion activated by the motor member 13 through the transmission element 132' into a controlled axial motion of the second operating member 250', for cutting the wire 2 (see FIGS. 55 and 56). A pair of radial pins is preferably provided, preferably diametrically opposed on the external surface of the second operating member 250', each element being engaged in a respective longitudinal slit 410' of the fixed knife 41'.

More precisely, the fixed knife 41' can be made up of a sleeve fixed to the body 10' of the apparatus 1' and inserted externally into the cutting portion 252' of the second operating member 250'. In particular, the fixed knife 41' can include the mouth 17' for inserting the wire 2 into the binding head 20'. Thanks to the guide made by the slit 410', the second operating member 250' can be operated in a translational cutting motion that brings said cutting edge at the first space 53*a*' to cut the portion of wire 2 inserted in the mouth 17'. The edge delimiting the end of the second space 53*b*', on the other hand, by virtue of the same translational motion, can tighten the opposite end of the wire 2 against the fingers 26' of the first operating member 240', in particular abutting on part of them, as described below. In particular, thanks to said differentiated extension, said edge can tighten the end of the wire 2 before shearing the wire 2 by the cutting edge delimiting the first space 53*a*' in the cutting stroke of said translational motion.

The fixed knife 41' is preferably blocked axially, in particular at a lower end, by a lid 111' fixed to the body 10' of the apparatus 1'.

The binding head includes, similarly to the previous embodiments, the rearrangement mechanism 18'. It includes a lever preferably articulated to the fixed lid 111' and engaged on the periphery of the second operating member 250' with the aid of elastic contrast means. The rearrangement mechanism 18' allows in particular the rearrangement of the operating members at the end of the binding cycle. More precisely, the lever of the rearrangement mechanism 18' allows the rotation of the second operating member 250' in one direction and prevents it, being stuck, in the opposite direction. The mechanism can be used in particular to return the pins 255' of the cutting portion 252' into the guide slits 410' made on the lid 111' and on the fixed knife 41'.

The first operating member 240' is coaxially inserted inside the second operating member 250' by the interposition of a third guide element 241' made for example in the shape of a tooth, inserted for example transversely, preferably radially, inside a respective seat 244' preferably open on the outer surface of the first operating member 240'. The third guide element 241' is inserted in the seat 244' by interposing elastic means 55' to abut a closing element 245' fixed to the seat 244' (see FIGS. 55 and 59).

The first operating member 240' also forms a guide groove 242' capable of receiving the pin 254' attached to the second operating member 250'. The groove 242', in particular, develops along a longitudinal direction parallel to the binding axis A' on the external surface of the first operating element 240' and is in communication with the seat 244'. The groove 242' advantageously forms a widening 243', in the circumferential direction, on which said second guide element 241', for example shaped, protrudes to correspondingly guide the first operating member 240' with respect to the second operating member 250'. More precisely, the longitudinal part of the groove 242' allows the second operating member 250' to slide outside the first operating member 240' in the translational cutting motion, in particular downwards, and to rotate integrally with it during the binding step after cutting. The widening 243' of the groove 242', on the other hand, enables a controlled relative rotational motion between the first operating member 240' and the second operating member 250', in a return stroke, for example upward stroke, for releasing the finished binding 100".

Similarly to the embodiments described above, the first operating member 240' also forms at least a pair of fingers 26', preferably four fingers 26', distributed angularly around the binding axis A'.

Figure 58:
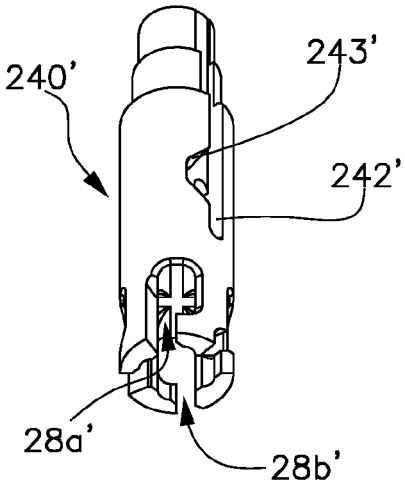
FIGS. 58 and 59 are respectively a perspective view from different angles of a further detail used in the binding head illustrated in FIG. 51.
Figure 59:
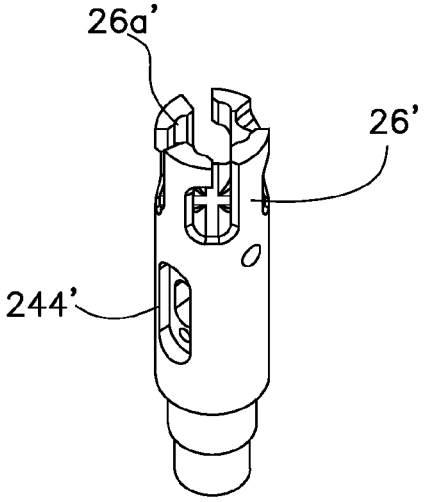
Figure 62:
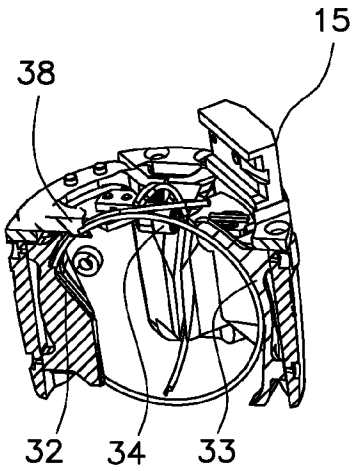
FIGS. 60, 61, 62 are respectively a calendering assembly used in the apparatus illustrated in FIG. 49.
Figure 61:
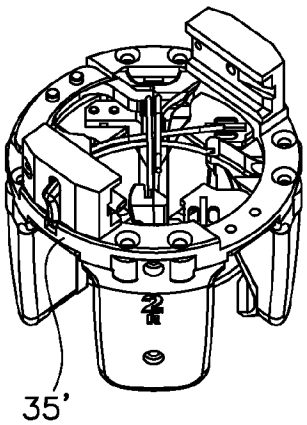
Figure 60:
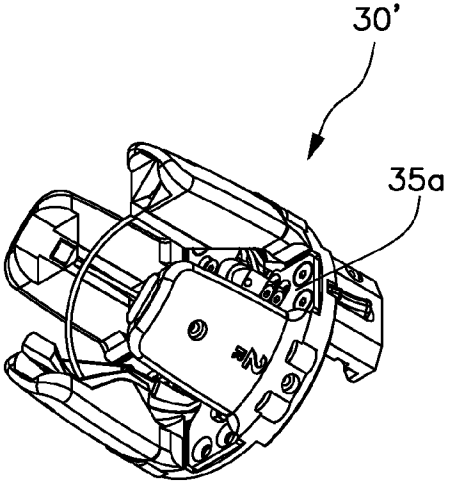

The passages 28*a*', 28*b*' are therefore defined between the fingers 26', intended to house the ends of wire 2 (see FIG. 58).

The passages 28*a*', 28*b*' and the spaces 53*a*', 53*b*' overlap in a variable manner, defining the first opening 20*a*' and the second opening 20*b*', varying from the open configuration to the holding configuration, to enable the binding steps.

The fingers 26' of the first operating member 240', unlike the embodiments described above, each form a support portion 26*a*', for example a hook-shaped end, intended to interact with the respective edge delimiting the first space 53*a*' and respectively the second space 53*b*' of the second operating member 250' for supporting each end of the wire 2 when it is tightened and bent by the second operating member 250', as described below.

The apparatus 1' also comprises the calendering assembly 30' which is functionally and structurally substantially similar to the same assembly described in the other embodiments. The calendering assembly 30' can be also applied to types of binding heads different from those described in this patent application.

It should be noted only that the calendering assembly 30' provides for a plurality of shaped recesses 35', for example four, having the function of allowing an undifferentiated support of the apparatus 1' on the first element 3 or on the second element 4 arranged at intersection, indifferently for cases in which the supporting element is arranged closer to or further away from the binding head 20, 20'. For this reason, flexibility in the orientation of the apparatus 1' is allowed, as it is not necessary for a particular pair of recesses to rest on the closest or most distant element (see FIGS. 60, 61, 62).

Furthermore, the calendering assembly 30' internally shapes a stop 38, for example in the form of a protrusion or similar component, capable of abutting the end of the wire 2 to stop its advancement at the end of the winding step through the input track 32 and then the output track 33. In particular, the stop 38 is suitably arranged at the side of the entrance to the input track 32 to block the return of the end of the wire 2 already wound around the elements 3, 4. Finally, the calendering assembly 30' preferably comprises attachment means 15 of the rapid type, for the removable connection to the body 10, 10' of the apparatus 1, 1'.

The operation of the apparatus 1' according to this embodiment is understandable from the above description.

Figure 63B:
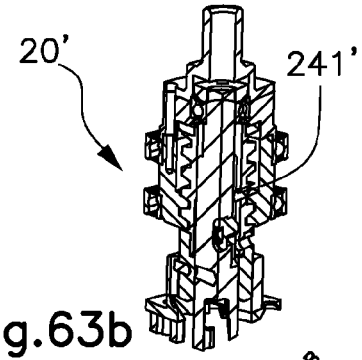
FIGS. 63*a* and 63*b* respectively show a sectional view of the same binding head, according to the planes LXIIIA-LXIIIA and LXIIIB-LXIIIB indicated in FIG. 63, in a first operating step in which only one wire is shown.
Figure 63A:
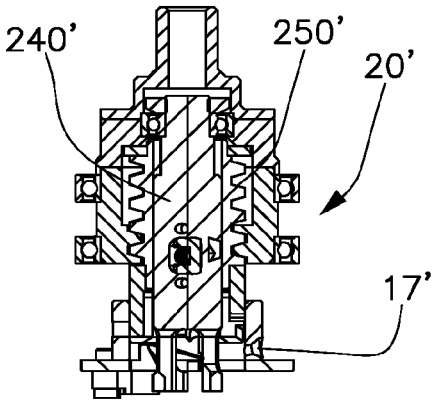
Figure 63:
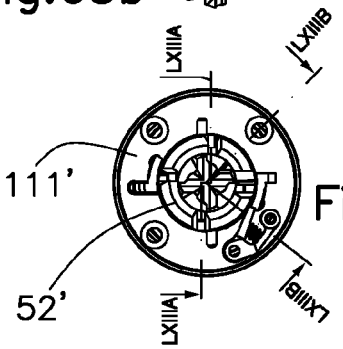
FIG. 63 is a side view of the binding head illustrated in FIG. 53.

In an initial step, the motor member 13 is operated to cause the second operating member 250' to rise along the binding axis A'. Basically, thanks to the guidance made by the first guide member 254' inside the groove 242', which therefore blocks a relative rotation between the two operating members 240', 250' during this step, the second operating member 250' slides in axial direction externally to the first operating member 240' which instead remains fixed at the same height with respect to the binding axis A' (see FIGS. 63*a*, 63*b*, 63).

Figure 64B:
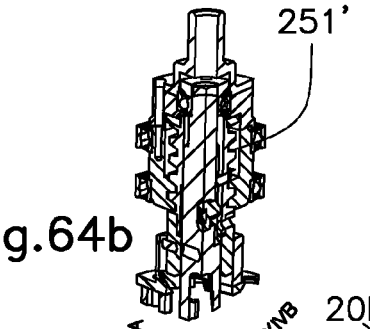
Figure 64A:
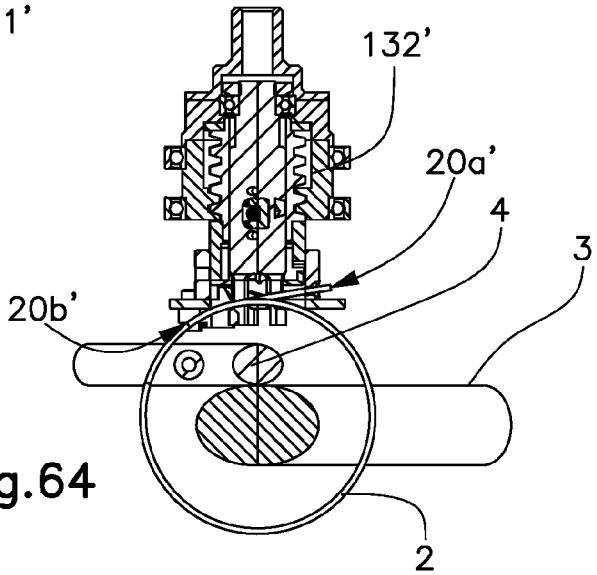
Figure 64:
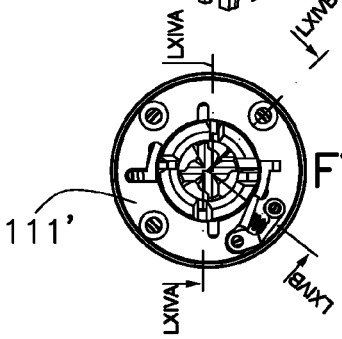

During a second feeding step, the drawing elements 7 are activated which feed each wire 2, making it pass through the calendering roller 34 and the input 32 and the outlet 33 tracks of the calendering assembly. In this way the wires are calendered, crossed with each other, winding the elements to be bound. At the same time, the four ends of the wires 2 pass through the appropriate passages 28*a*', 28*b*' of the first operating element 240 (see FIGS. 64*a*, 64*b*, 64).

After, the second operating member 250' begins the relative translation stroke with respect to the first operating member 240'. In particular, the motor member 13 is actuated and by coupling the transmission element 132' with the transmission portion 251' of the second operating element 250', the latter is actuated in a relative translational motion, in particular downward with respect to the first operating member 240' arranged inside thereof (see FIGS. 65*a*, 65*b*, 65).

During the translation, in particular downward, of the cutting portion 252' of the second operating member 250', the edge delimiting the second spaces 53*b*' slightly engages, blocking them, the free ends of the wires 2. By activating the drawing elements 7 backwards, the wires 2 are pulled back, to make them adhere around the elements 3, 4 to be bound (see FIGS. 66*a*, 66*b*, 66).

Continuing to descend the cutting portion 252', the wires 2 are cut, which in the case described but not limited to are two, in particular wound crossed (see FIGS. 67*a*, 67*b*, 67).

By completing the translation stroke of the cutting portion 252', the ends of the wires 2 are fully clamped between the edge of the second space 53*b*' and the support portion 26*a*' of the finger 26. More precisely, the tightening is achieved by bending the four free ends around the hooks present on the first operating member 240', through the descent of the cutting portion 252' and the engagement of the respective edges delimiting the spaces 53*a*', 53*b*' (see FIGS. 68*a*, 68*b*, 68).

The motor member 13 then activates the integral rotation of the first operating member 240' and of the second operating member 250' around the binding axis A', thus twisting the wire 2, which tightens and winds the first element 3 and the second element 4 (see FIGS. 69*a*, 69*b*, 69). More precisely, during this step the integral rotation of the two operating members is made possible by the fact that the second guide element 255' comes out of the slit 410' of the fixed knife 41'.

At this point, the return stroke of the cutting portion 252' is activated, with a movement of the motor member 13 in the opposite direction, in particular with an ascent stroke, up to an intermediate level. Thanks to the cam mechanism comprising the tooth 241', the first operating member 240' can rotate with respect to the second operating member 250', so as to release the bent ends of the wire 2 from the supporting portions 26*a*' (see FIGS. 70*a*, 70*b*, 70).

The binding 100" made (see FIG. 71) therefore has a wound portion 103', a twisted portion 101' and bent ends 104' protruding from the twisted portion 101'. The simple bending of the ends of the wire 2 minimizes the consumption of the wire 2 and advantageously limits the height of the binding.

The apparatus according to the invention enables effective and reliable bindings.

In the practical embodiment of the invention, the used materials, as well as the shape and the dimensions, may be modified depending on needs.

Should the technical features mentioned in any claim be followed by reference signs, such reference signs were included strictly with the aim of enhancing the understanding of the claims and hence they shall not be deemed restrictive in any manner whatsoever on the scope of each element identified for exemplifying purposes by such reference signs.

The invention claimed is:

1. A method for binding metal wires to a first element and to a second element comprising the steps of:

a. arranging said first element and said second element in a superimposed crossed configuration, so as to define four respective quadrants (Q1, Q2, Q3, Q4) at a crossing zone on a plane containing the longitudinal axis (Y)

of one of said first element and said second element and the projection (P) of the longitudinal axis of the other one;

b. inserting a calendering assembly mounted around a binding axis (A, A') in front of a binding apparatus, abutting against at least one of said first element and said second element, at said crossing zone, engaging said four quadrants (Q1, Q2, Q3, Q4) with respective winding prongs of said calendering assembly;

c. feeding through said calendering assembly arranged at said crossing zone a wire and a further wire, performing a first winding wound between two of the four said quadrants (Q1, Q2, Q3, Q4) by calendering and having a first pair of opposite branches of said wire, and a second winding wound between the remaining two of said four quadrants (Q1, Q2, Q3, Q4) and having a second pair of opposite branches of said further wire, around said first element and/or said second element;

d. cutting said wire and said further wire, in a suitable phase relationship, by means of a cutting assembly of said binding apparatus, thus obtaining a respective pair of ends for each winding;

e. holding said ends of said first pair and said second pair of the opposite branches by means of a binding head of said binding apparatus, mounted inside said calendering assembly and rotatable around said binding axis (A, A');

f. rotating said binding head around said binding axis (A, A'), to twist together said first pair and said second pair of opposite branches, held by said ends by said binding head, around said binding axis (A, A'), obtaining an at least double binding around said first element and said second element, in which said opposite branches converge from each of said quadrants (Q1, Q2, Q3, Q4) to said binding axis (A, A').

2. The method of claim 1, wherein said step c. of feeding said wire and said further wire through said calendering assembly provides for winding said wire and said further wire along respective winding paths mutually crossed around said first element and said second element, thus performing, following the step of operating said binding head, a double binding crossed around said first element and said second element.

3. The method of claim 1, wherein said step c. of feeding said wire and said further wire provides for guiding said wire and said further wire along substantially parallel respective winding paths, separated by said crossing zone, around said element which, between said first element and said second element, is farther from said binding head when said calendering assembly is arranged in abutment, said step f. of operating said binding head thereby performing a double parallel binding around said first element and/or said second element.

4. The method of claim 1, wherein said phase b. of inserting said calendering assembly provides for placing respective shaped recesses made in front of said calendering assembly abutting against said first element or said second element.

5. An apparatus for binding metal wires and similar products around a first element and a second element superimposed and crossed at a crossing zone, so as to define four respective quadrants (Q1, Q2, Q3, Q4) at said crossing zone on a plane containing the longitudinal axis (Y) of one of said first element and said second element and the projection (P) of the longitudinal axis of the other one, comprising a body for receiving by unwinding at least one wire and a further wire, a calendering assembly carried at the front by said body and arranged around a longitudinal binding axis (A, A'), for guiding said wire and said further wire respectively in a first winding wound between two of the four said quadrants (Q1, Q2, Q3, Q4) and having a first pair of opposite branches of said wire, and in a second winding wound between the remaining two of said four quadrants (Q1, Q2, Q3, Q4) and having a second pair of opposite branches of said further wire, around said first element and/or said second element in a respective calendering operating space defined inside said calendering assembly, a binding head carried by said body along said binding axis (A, A'), enclosed within said calendering assembly, for reciprocally twisting said opposite branches of said wire and of said further wire being wound around said binding axis (A, A'), wherein said calendering assembly comprising for each winding a respective fork comprising a first prong internally having an input track and a second prong internally having a return track opposite to said input track, with respect to said binding axis (A, A'), so as to form a complete winding path for said wire and said further wire, a free area being interposed between said first prong and said second prong of each fork, to throw said wire and respectively said further wire from said input track to said return track to be wound around said first element and/or said second element.

6. The apparatus of claim 5, wherein said calendering assembly forms a pair of said forks, comprising as many respectively crossed or parallel winding paths, each for a respective said wire.

7. The apparatus of claim 5, wherein said prongs of said forks have a substantially axial development, to enable said calendering assembly to be inserted abutting against said first element and/or said second element with a substantially axial movement.

8. The apparatus of claim 6, wherein said input track and said return track are made by means of inserts applied to said calendering assembly.

9. The apparatus of claim 5, wherein said return track forms an at least initial portion in the form of a guide, to guide the insertion of said wire thrown from said input track.

10. The apparatus of claim 5, wherein said input track and/or said return track at least partially form a groove for guiding said wire during said winding around said at least one first element and/or during a progressive tightening around thereof.

11. The method of claim 1, wherein holding said ends of said first pair and said second pair of the opposite branches by means of a binding head of said binding apparatus provides for bending said ends of said first pair and said second pair of the opposite branches.

* * * * *